US009684258B2

(12) United States Patent
Suzuki

(10) Patent No.: US 9,684,258 B2
(45) Date of Patent: Jun. 20, 2017

(54) IMAGE FORMING APPARATUS CAPABLE OF SWITCHING OPERATION MODE

(71) Applicant: Yasuhiro Suzuki, Nagoya (JP)

(72) Inventor: Yasuhiro Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 154 days.

(21) Appl. No.: 13/626,248

(22) Filed: Sep. 25, 2012

(65) Prior Publication Data

US 2013/0084105 A1 Apr. 4, 2013

(30) Foreign Application Priority Data

Sep. 29, 2011 (JP) ..... 2011-214650

(51) Int. Cl.
*G03G 15/01* (2006.01)
*G03G 15/00* (2006.01)
*G03G 21/16* (2006.01)

(52) U.S. Cl.
CPC ..... *G03G 15/0121* (2013.01); *G03G 15/50* (2013.01); *G03G 21/1647* (2013.01)

(58) Field of Classification Search
CPC ..... G03G 15/0121; G03G 21/1647
USPC ..... 399/228
See application file for complete search history.

(56) References Cited

U.S. PATENT DOCUMENTS 7,526,232 B2 4/2009 Kamimura et al.
2003/0138270 A1* 7/2003 Matsuoka ..... 399/228
2007/0053719 A1 3/2007 Kamimura et al.
2007/0177899 A1 8/2007 Kawamura
2008/0226345 A1* 9/2008 Yoon ..... 399/167
2010/0111562 A1 5/2010 Okabe et al.

FOREIGN PATENT DOCUMENTS

JP 2003-208024 A 7/2003
JP 2007-072021 A 3/2007
JP 2007-213023 A 8/2007
JP 2010-107890 A 5/2010

OTHER PUBLICATIONS

Jan. 20, 2015—(JP) Office Action—App 2011-214650.
Jun. 30, 2015—(JP) Office Action—App 2011-214650.

* cited by examiner

*Primary Examiner* — David M Gray
*Assistant Examiner* — Thomas Giampaolo, II
(74) *Attorney, Agent, or Firm* — Banner & Witcoff, Ltd.

(57) ABSTRACT

An image forming apparatus includes: first and second photosensitive drums; first and second developing rollers each defining an axis in an axial direction; first and second driving-force inputting sections; first and second couplings; and a connecting mechanism. A driving force inputted to each coupling is transmitted to each developing roller via each driving-force inputting section when each coupling is connected to the corresponding driving-force inputting section. The connecting mechanism is movable between a first position and a second position to cause the first and second couplings to move in the axial direction such that the first and second couplings are connected or disconnected relative to the first and second driving-force inputting sections.

25 Claims, 12 Drawing Sheets

IMAGE FORMING APPARATUS CAPABLE OF SWITCHING OPERATION MODE

CROSS REFERENCE TO RELATED APPLICATION

This application claims priority from Japanese Patent Application No. 2011-214650 filed Sep. 29, 2011. The entire content of the priority application is incorporated herein by reference.

TECHNICAL FIELD

The present invention relates to an electro-photographic type image forming device.

BACKGROUND

Known is a tandem type color laser printer provided with developing rollers and photosensitive drums for colors of yellow, magenta, cyan, and black. There has been proposed a conventional tandem type color laser printer capable of switching its printing operation mode between monochromatic printing mode in which only a developing roller and a photosensitive drum for the color of black are operated and a color printing mode in which all developing rollers and photosensitive drums are operated.

The printer includes a reversible motor and a pivot gear coupled thereto. When the motor is rotated in the forward direction, the pivot gear is pivotally moved to one direction to be engaged with a developing gear provided at a developing unit for the color of black. This, the printer is switched to the monochromatic mode such that the rotation of the motor is transmitted only to the black developing unit. On the other hand, when the motor is rotated in the reverse direction, the pivot gear is pivotally moved to a direction opposite to the one direction to be engaged with all developing gears for all developing units. Thus, the printer is switched to the color mode such that the rotation of the motor is transmitted to the all developing units.

SUMMARY

In the above-described color printer, a gear train configured to transmit driving force from a drive source to the color developing units is provided separate from a gear train configured to transmit driving force from the drive source to the black developing unit. Accordingly, the gear train is complicated for transmission of the driving force from the drive source to the respective developing units.

In view of the foregoing, it is an object of the present invention to provide a compact and mechanically simple image forming device capable of switching its operation mode between monochromatic mode and color mode.

According to an aspect of the present invention, there is provided an image forming apparatus including: a first photosensitive drum; a first developing roller configured to be in contact with the first photosensitive drum, the first developing roller defining a first axis extending in an axial direction; a first driving-force inputting section configured to receive a driving force therein and transmit the driving force to the first developing roller; a first coupling connectable to the first driving-force inputting section for transmitting the driving force thereto; a second photosensitive drum; a second developing roller configured to be in contact with the second photosensitive drum, the second developing roller defining a second axis extending in the axial direction; a second driving-force inputting section configured to receive a driving force therein and transmit the driving force to the second developing roller; a second coupling connectable to the second driving-force inputting section for transmitting the driving force thereto; and a connecting mechanism configured to move the first coupling in the axial direction to permit the first coupling to be connected to and disconnected from the first driving-force inputting section, and configured to move the second coupling in the axial direction to permit the second coupling to be connected to and disconnected from the second driving-force inputting section. The connecting mechanism is configured to move between a first position and a second position, the connecting mechanism at the first position causing the first coupling and the second coupling to be connected to the first driving-force inputting section and the second driving-force inputting section respectively, the connecting mechanism at the second position causing the first coupling to be connected to the first driving-force inputting section but causing the second coupling to be disconnected from the second driving-force inputting section.

According to still another aspect of the present invention, there is provided an image forming apparatus including: a first photosensitive drum; a first developing roller configured to be in contact with the first photosensitive drum, the first developing roller defining a first axis extending in an axial direction; a first driving-force inputting section configured to receive a driving force therein and transmit the driving force to the first developing roller; a first coupling connectable to the first driving-force inputting section for transmitting the driving force thereto; a second photosensitive drum juxtaposedly arrayed with the first photosensitive drum in a predetermined direction perpendicular to the axial direction; a second developing roller configured to be in contact with the second photosensitive drum, the second developing roller defining a second axis extending in the axial direction; a second driving-force inputting section configured to receive a driving force therein and transmit the driving force to the second developing roller; a second coupling connectable to the second driving-force inputting section for transmitting the driving force thereto; and a movable member configured to move the first coupling in the axial direction to permit the first coupling to be connected to and disconnected from the first driving-force inputting section, and configured to move the second coupling in the axial direction to permit the second coupling to be connected to and disconnected from the second driving-force inputting section. The movable member is configured to move between a first position and a second position, the movable member at the first position causing the first coupling and the second coupling to be connected to the first driving-force inputting section and the second driving-force inputting section respectively, the movable member at the second position causing the first coupling to be connected to the first driving-force inputting section but causing the second coupling to be disconnected from the second driving-force inputting section.

BRIEF DESCRIPTION OF THE DRAWINGS

The particular features and advantages of the invention as well as other objects will become apparent from the following description taken in connection with the accompanying drawings, in which:

FIG. 2 is a perspective view of a driving-force inputting unit configured to input a driving force to each developing cartridge shown in FIG. 1 and a;

DETAILED DESCRIPTION

Figure 1:
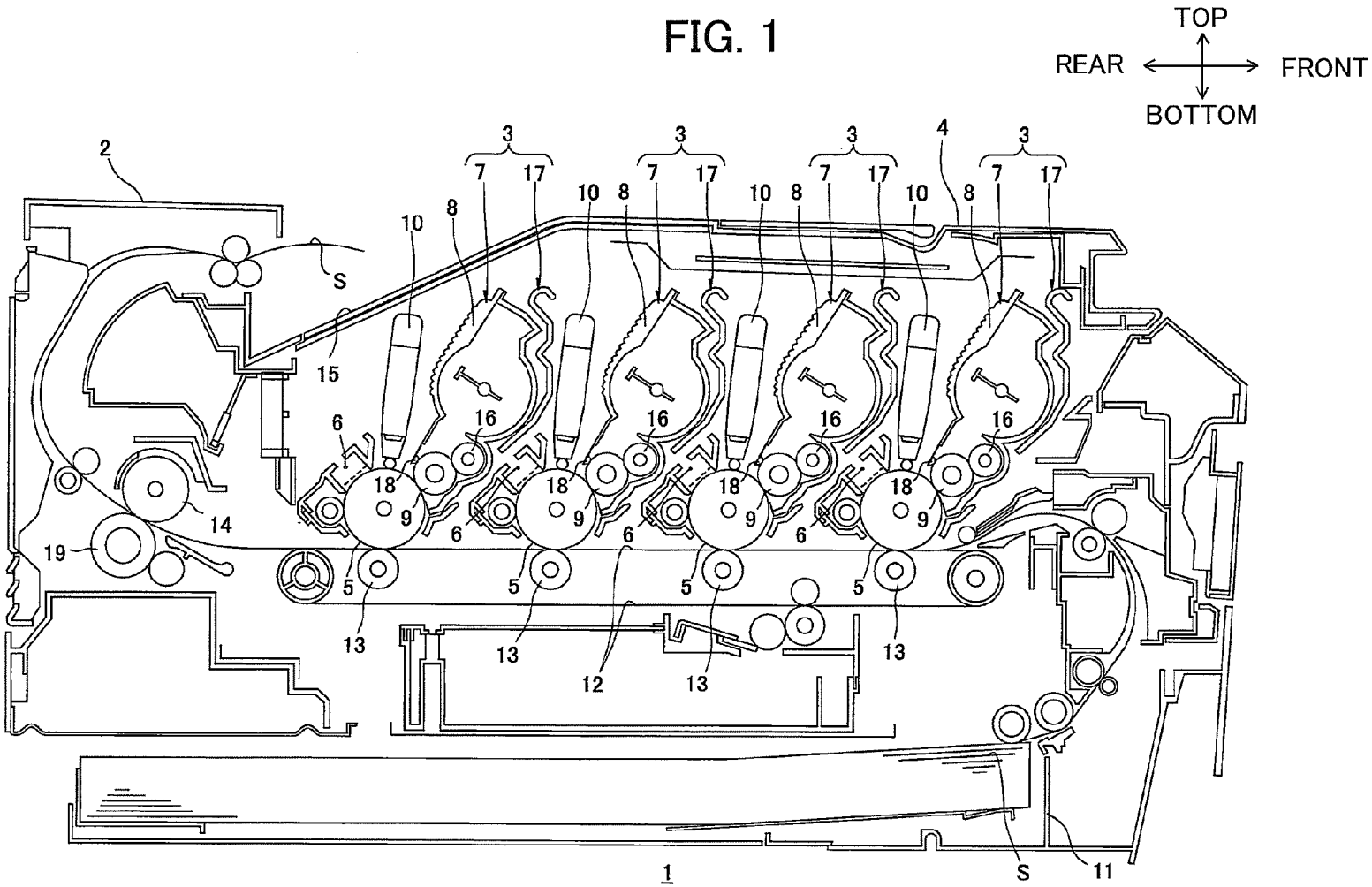
FIG. 1 is a cross-sectional view of a color printer as an image forming device according to one embodiment of the present invention, the color printer including a plurality of developing cartridges.

A printer 1 as an image forming apparatus according to one embodiment of the present invention will be described while referring to FIGS. 1 to 12 wherein like parts and components are designated by the same reference numerals to avoid duplicating description.

1. Overall Structure of Color Printer

As shown in FIG. 1, the printer 1 is a horizontal direct tandem type color printer 1. Throughout the specification, the terms "upward", "downward", "upper", "lower", "above", "below", "beneath", "right", "left", "front", "rear" and the like will be used assuming that the printer 1 is disposed in an orientation in which it is intended to be used. Specifically, in FIG. 1, the right side is a front side, and a left side is a rear side of the printer 1. Further, "right side" and "left side" will be used when viewing the printer 1 from its front side. That is, the near side in FIG. 1 is the left side, and the far side in FIG. 1 is the right side of the printer 1.

The printer 1 includes a main casing 2 having a generally box shape. The main casing 2 has an upper end portion provided with a top cover 4 which can be opened or closed. In the main casing 2, four process cartridges 3 corresponding to respective colors are provided.

The process cartridges 3 are detachably mountable in the main casing 2. When mounted, the process cartridges 3 are juxtaposedly arrayed in a front-to-rear direction with a space between neighboring cartridges in an order of cyan, magenta, yellow and black cartridges from the front to the rear. Each process cartridge 3 includes a drum cartridge 17 and a developing cartridge 7 detachable from and attachable to the drum cartridge 17.

Each drum cartridge 17 includes a photosensitive drum 5. The photosensitive drum 5 is cylindrical shaped and extends in a left-to-right direction (lateral direction), and is rotatably supported to a drum frame of the drum cartridge 17.

Each developing cartridge 7 includes a developing roller 9 extending in an axial direction parallel to the lateral direction. The developing roller 9 is rotatably supported to a developing cartridge frame 8 of the developing cartridge 7. The developing roller 9 has a rear portion exposed to an outside from a rear end portion of the developing cartridge frame 8 such that the developing roller 9 is positioned frontward and upward of the photosensitive drum 5 so as to be in contact with the same.

The developing cartridge 7 also includes a supply roller 16 for supplying toner to the developing roller 9, and a regulation blade 18 for regulating a thickness of a toner layer formed on the developing roller 9. A toner container (shown without a reference numeral) is positioned above the supply roller 16 and the regulation blade 18 for containing a toner as a developing agent.

The toner in the developing cartridge 7 is triboelectrically charged with positive polarity between the supply roller 16 and the developing roller 9, and is carried on a peripheral surface of the developing roller 9 in a form of a thin toner layer having a constant thickness.

A scorotron charger 6 and an LED unit 10 are provided in confrontation with each photosensitive drum 5. After an outer peripheral surface of the photosensitive drum 5 is uniformly charged by the scorotron charger 6, the surface is exposed to light by the LED unit 10 based on a predetermined image data to form an electrostatic latent image on the surface. Then, by supplying the toner carried on the developing roller 9 to the corresponding photosensitive drum 5, a visible toner image corresponding to the electrostatic latent image is formed on the outer peripheral surface of the photosensitive drum 5.

A sheet tray 11 is provided at a bottom portion of the main casing 2 for accommodating sheets S therein in a stacked state. A conveyer belt 12 extends in the front-to-rear direction and is disposed at a position immediately below the photosensitive drums 5. Transfer rollers 13 are provided opposite to the photosensitive drums 5 with respect to the conveyer belt 12. A generally U-shaped passage is provided between the sheet tray 11 and the conveyer belt 12. Further, various feed rollers are provided along the U-shaped passage. The sheets S in the sheet tray 11 are successively fed into the U-shaped passage at a prescribed timing, and each sheet S is supplied to a position between the conveyer belt 12 and each photosensitive drum 5. Then, each sheet S carried on the conveyer belt 12 is moved rearward and passed through the photosensitive drums 5 and the transfer rollers 13, whereupon toner image of each color is successively transferred onto the sheet S, thereby providing a color image on the sheet S.

A fixing unit including a heat roller 14 and a pressure roller 19 is provided rearward (downstream) of the conveyer belt 12. The sheet S is pressurizingly heated when the sheet S passes between the heat roller 14 and the pressure roller 19, thereby thermally fixing the color image to the sheet S.

A discharge tray 15 is provided at the top cover 4, and a generally U-shaped passage is provided between the fixing unit and the discharge tray 15. The sheet S carrying the color image is fed along the U-shaped passage and is discharged onto the discharge tray 15.

2. Developing Cartridge

Figure 2:
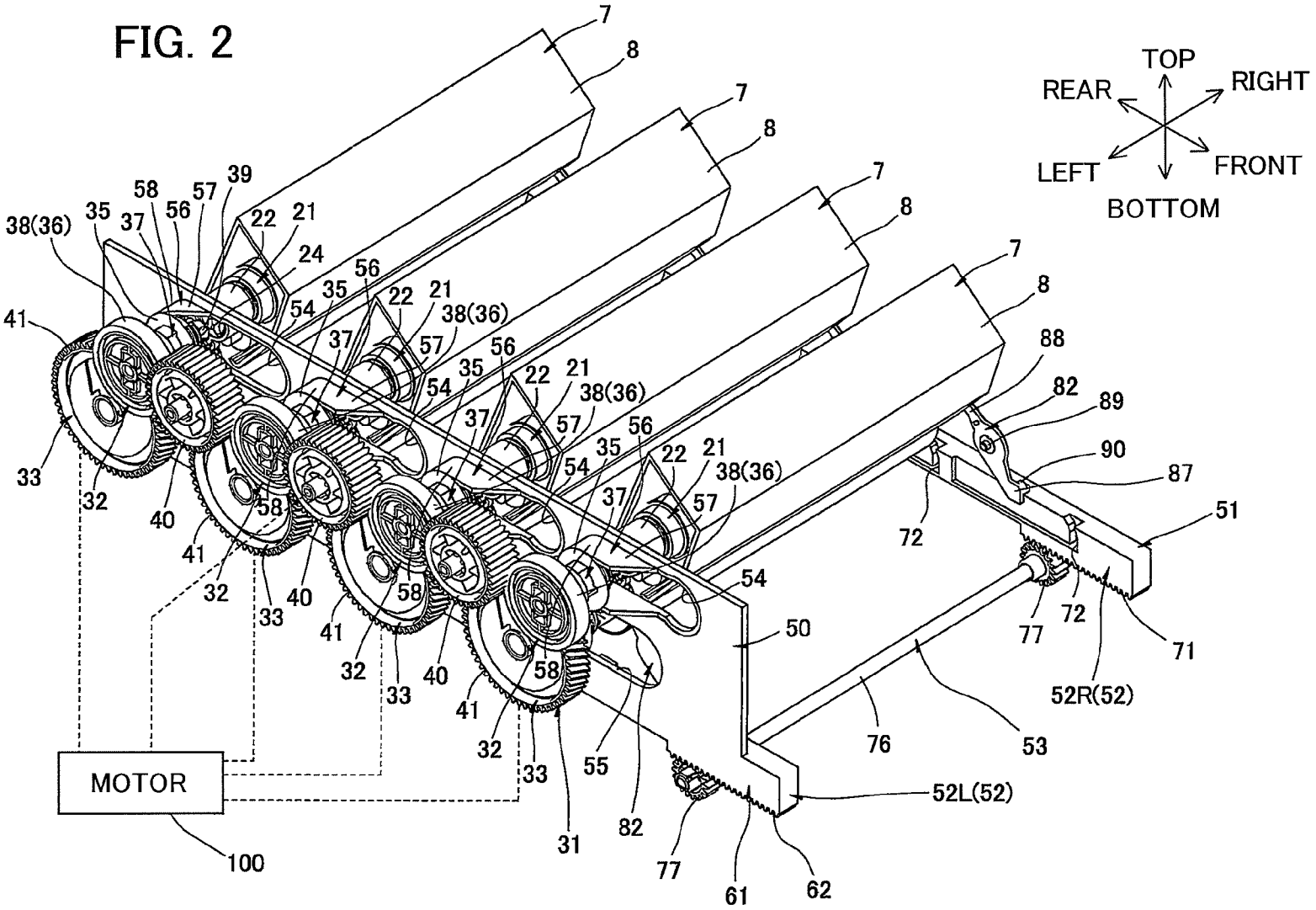
Figure 3:
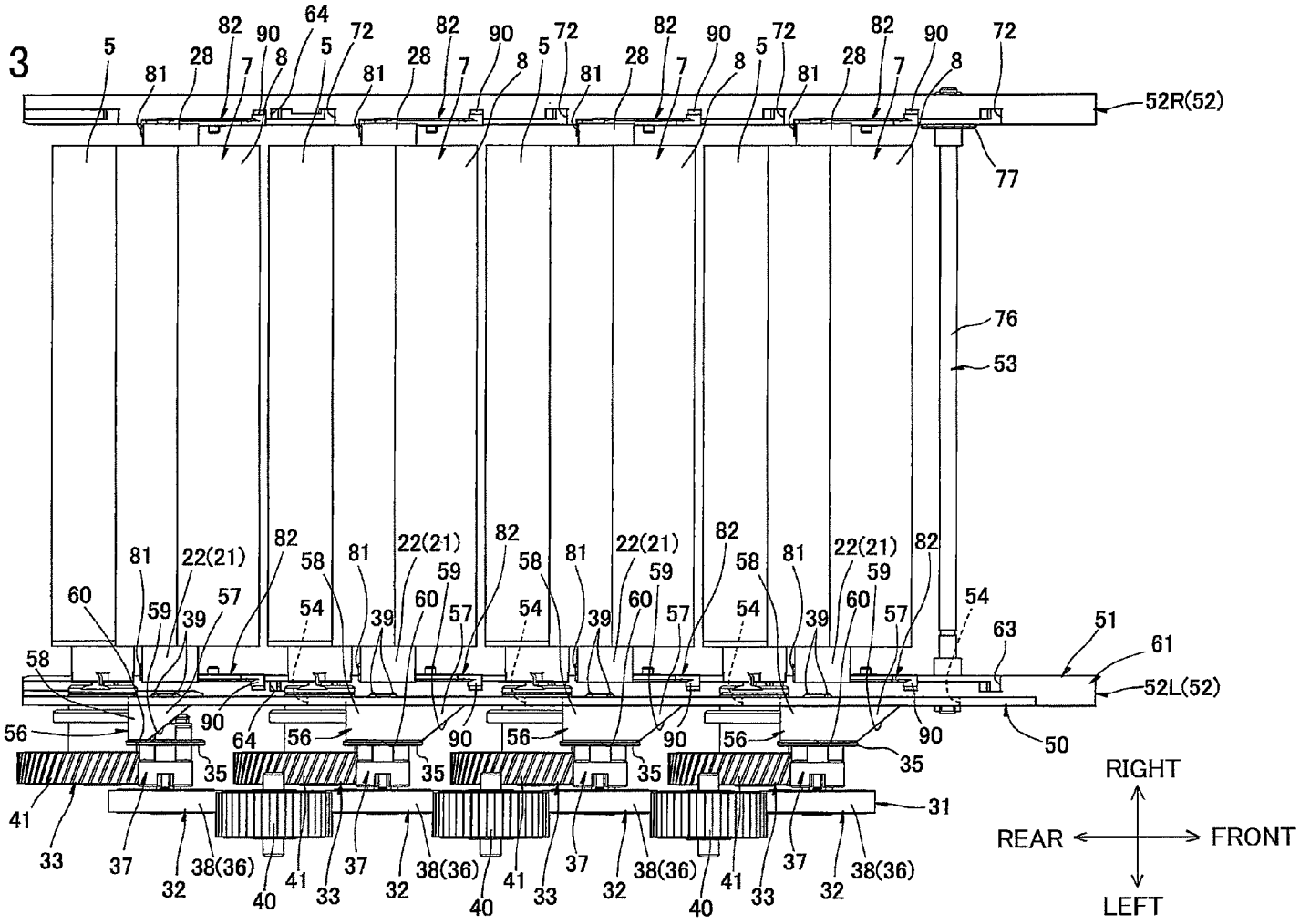
FIG. 3 is a plan view of the driving-force inputting unit of FIG. 2, wherein the driving-force inputting unit is in an all-separation mode.
Figure 4:
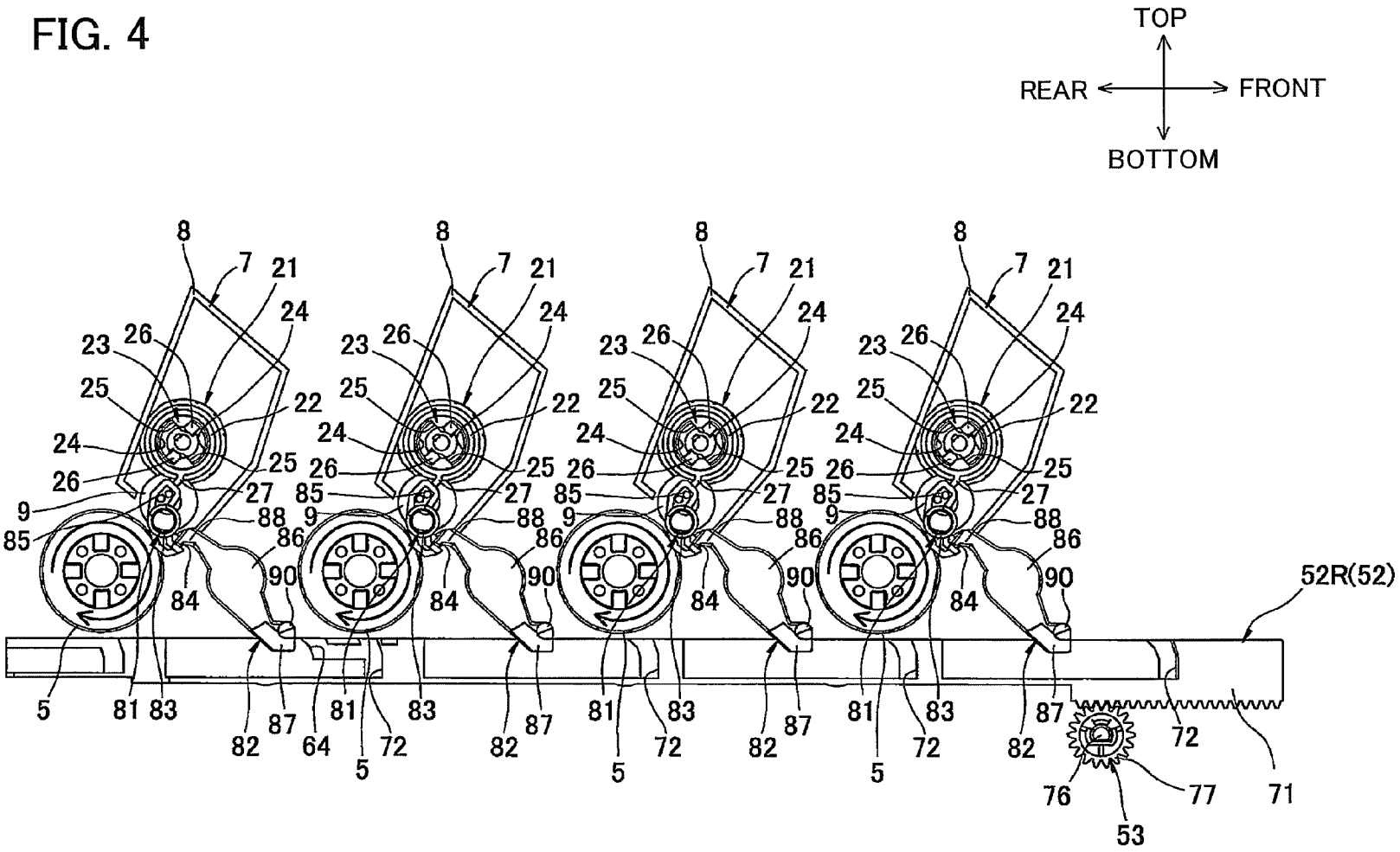
FIG. 4 is a side cross-sectional view of the driving-force inputting unit of FIG. 2, wherein the driving-force inputting unit is in the all-separation mode.

The developing cartridge 7 includes the developing cartridge frame 8. As shown in FIGS. 2 to 4, the developing cartridge frame 8 has a left end portion on which a developing coupling portion 21 is provided for inputting a driving force from a motor 100 disposed within the main casing 2 to the supply roller 16 and the developing roller 9.

The developing coupling portion 21 includes a developing-coupling cover 22, and a developing-coupling female member 23 rotatably supported within the developing coupling cover 22.

The developing-coupling cover 22 has a generally cylindrical shape, and protrudes leftward from a left end surface of the developing cartridge frame 8. The developing-coupling cover 22 includes an abutment portion 27 in a form of a rib (see FIG. 4). The abutment portion 27 extends in the lateral direction and protrudes downward and rearward from a lower peripheral surface of the developing-coupling cover 22.

The developing-coupling female member 23 is formed in a generally columnar shape extending in the lateral direction. The developing-coupling female member 23 has a right end portion on which gear teeth (not shown) are formed such that the gear teeth is in meshing engagement with a gear train (now shown) for transmitting the driving force to the supply roller 16 and the developing roller 9.

The developing-coupling female member 23 has a left end portion on which two coupling recesses 24 are formed (see FIG. 4). Specifically, each coupling recess 24 is depressed rightward from a left end surface of the developing-coupling female member 23 such that the coupling recess 24 has a generally fan-like shape whose center angle is about 90 degrees. The two coupling recesses 24 are connected to each other such that each coupling recess 24 has an apex portion connected to each other.

Each coupling recess 24 has a flat end surface 25 extending in the lateral direction, the end face 25 being positioned downstream in a clockwise direction in a left side view. Each coupling recess 24 has a sloped surface 26 extending leftward as approaching upstream in the clockwise direction in a left side view, the sloped surface 26 being positioned upstream in the clockwise direction when the coupling recess 24 is viewed from its left side.

Further, as shown in FIG. 3, the developing cartridge 7 has a right end portion on which a separation boss 28 is provided.

The separation boss 28 is formed in a generally cylindrical shape whose diameter is identical to that of the developing-coupling cover 22. The separation boss 28 is positioned such that the separation boss 28 defines an axis coincident with that of the developing-coupling cover 22. The separation boss 28 is also formed with an abutment portion (not shown) whose shape is identical to that of the abutment portion 27 of the developing-coupling cover 22, and whose position is coincident with that of the abutment portion 27 of the developing-coupling cover 22 when projected in the lateral direction.

3. Drum Cartridge

Each drum cartridge 17 includes the drum frame (shown without a reference numeral) having a generally frame-like shape extending in the lateral direction for accommodating therein the corresponding developing cartridge 7.

Each drum frame has a left side wall on which a groove (not shown) is formed for exposing the developing coupling portion 21, and a right side wall on which a groove (not shown) is formed for exposing the separation boss 28.

Further, as shown in FIG. 4, each drum cartridge 17 includes a pair of first separation members 81 for separating the developing cartridge 7 from the corresponding photosensitive drum 5.

Specifically, the two first separation members 81 are disposed such that, one is positioned below the separation boss 28 and the other is positioned below the developing-coupling cover 22 when the developing cartridge 7 is mounted on the drum cartridge 17.

Each first separation member 81 integrally includes a pivot shaft 83, a contact portion 84 and a pressing portion 85.

The pivot shaft 83 is generally cylindrical shaped and defines an axis extending in the lateral direction. The pivot shaft 83 is supported to each side wall of the drum frame such that the first separation member 81 is pivotally movable about the axis of the pivot shaft 83 relative to the drum cartridge 17.

The contact portion 84 is generally flat plate-like shaped and extends downward from the pivot shaft 83. The contact portion 84 has a lower end portion which bends frontward. The pressing portion 85 is also generally flat plate-like shaped and extends upward from the pivot shaft 83. The pressing portion 85 has an upper end portion which bends frontward.

The first separation member 81 is pivotally movable between a pushing position (shown in FIG. 4) where the pressing portion 85 pushes the developing-coupling cover 22 or the separation boss 28 upward and frontward, and a releasing position (shown in FIG. 12) where the pressing portion 85 is retracted downward and rearward from the developing-coupling cover 22 or the separation boss 28 to release pushing the same.

4. Structure within Main Casing

As shown in FIGS. 2 and 3, a driving-force inputting unit 31, four drum-coupling male members 33 and a linearly movable cam mechanism 51 are disposed within the main casing 2.

(1) Driving-Force Inputting Unit

The driving-force inputting unit 31 functions to input the driving force from the motor 100 to the developing-coupling portion 21 of each developing cartridge 7. The driving-force inputting unit 31 includes four developing-coupling male assemblies 32 and three idle gears 40.

The four developing-coupling male assemblies 32 are juxtaposedly arrayed in the front-to-rear direction and spaced away from one another such that each developing-coupling male assembly 32 is positioned leftward of each developing cartridge 7.

Each developing-coupling male assembly 32 includes a fixed shaft 36 (see FIG. 11) and a movable shaft 37.

The fixed shaft 36 is fixedly disposed within the main casing 2. The fixed shaft 36 has a generally columnar shape extending in the lateral direction. The fixed shaft 36 has a left end portion whose diameter is larger than that of a remaining portion other than the left end portion of the fixed shaft 36. The left end portion of the fixed shaft 36 has a circumferential surface on which gear teeth 38 are formed such that the left end portion serves as a gear.

The movable shaft 37 extends in the lateral direction and has a generally cylindrical shape whose right end portion is closed. The movable shaft 37 has an inner diameter larger than an outer diameter of the portion of the fixed shaft 36 other than the left end portion serving as a gear. The movable shaft 37 is slidable in the lateral direction relative to the fixed shaft 36. The movable shaft 37 includes two coupling protrusions 39 and a flange portion 35.

The coupling protrusions 39 formed on the right end portion of the movable shaft 37. Specifically, the coupling protrusion 39 has a generally rectangular columnar shape extending rightward from a right end surface of the movable shaft 37. The coupling protrusions 39 are formed on diametrically opposite sides of the right end surface of the movable shaft 37. The coupling protrusion 39 has a length in a circumference direction of the movable shaft 37 shorter than a length of the coupling recess 24 in a circumferential direction of the developing-coupling female member 23.

The flange portion 35 is formed at a position generally center of the movable shaft 37 in the lateral direction and has a generally circular-shaped outer profile in a left side view. Specifically, the flange portion 35 protrudes radially outward an outer peripheral surface of the movable shaft 37 such that the flange portion 35 has an axis coincident with that of the movable shaft 37.

The movable shaft 37 is coupled to the fixed shaft 36 (a right end portion of the fixed shaft 36) from radially outward thereof, with some allowance, such that the movable shaft 37 does not rotate relative to the fixed shaft 36 but is slidable in the lateral direction relative to the fixed shaft 36.

With this construction, the movable shaft 37 is movable (slidable) between an advanced position (FIG. 11) where the movable shaft 37 advances rightward to be connected to the corresponding developing-coupling female member 23, and a retracted position (FIG. 3) where the movable shaft 37 retracts leftward from the advanced position to release its connection with the developing-coupling female member 23. Further, due to the allowance relative to the fixed shaft 36, the movable shaft 37 is slightly movable in a radial direction thereof relative to the fixed shaft 36.

The movable shaft 37 is biased rightward, due to a biasing member (not shown), such that the movable shaft 37 is normally at the advanced position.

The three idle gears 40 are disposed such that each idle gear 40 is interposed between the gear teeth 38 of the neighboring developing-coupling male assemblies 32 (the idle gears 40 are spaced away from one another and juxtaposed in the front-to-rear direction). That is, the idle gears 40 function to connect the gear teeth 38 of all the developing-coupling male assemblies 32 in series in the front-to-rear direction.

The driving force from the motor 100 disposed within the main casing 2 is inputted to the idle gear 40 positioned center among the three idle gears 40 in the front-to-rear direction. The inputted driving force is thus transmitted to each developing-coupling male assembly 32 via each idle gear 40.

(2) Drum-Coupling Male Member

The drum-coupling male members 33 serve to input the driving force from the motor 100 to each photosensitive drum 5. The four drum-coupling male members 33 are disposed within the main casing 2 such that each drum-coupling male member 33 is positioned leftward of each photosensitive drum 5. That is, the drum-coupling male members 33 are juxtaposedly arrayed in the front-to-rear direction and spaced away from one another.

The drum-coupling male member 33 has a generally columnar shape extending in the lateral direction. The drum-coupling male member 33 has a left end portion whose diameter is larger than that of a remaining portion other than the left end portion of the drum-coupling male member 33. The left end portion of each drum-coupling male member 33 has a circumferential surface on which gear teeth 41 are formed such that the left end portion serves as a gear. Also, each drum-coupling male member 33 has a right end portion that can be coupled to a drum-coupling female member (not shown) of the photosensitive drum 5 such that the drum-coupling male member 33 is incapable of rotating relative to the photosensitive drum 5. The drum-coupling male member 33 is configured to be connected to the drum-coupling female member (not shown) when the top cover 4 is closed, and disconnected from the drum-coupling female member (not shown) when the top cover 4 is opened.

As shown in FIG. 2, the driving force from the motor 100 is configured to be inputted to the gear teeth 41 of each drum-coupling male member 33.

(3) Linearly Movable Cam Mechanism

The linearly movable cam mechanism 51 includes a pair of linearly movable cams 52, four pairs of second separation members 82 and a driving-force transmission shaft 53.

The pair of linearly movable cams 52 is movable (slidable) in the front-to-rear direction. The pair of linearly movable cams 52 is configured of a left-side cam 52L and a right-side cam 52R.

The left-side cam 52L has a generally flat plate-like shape extending in the front-to-rear direction and having a rectangular shape in a left side view. The left-side cam 52L is disposed leftward of each developing cartridge 7 to confront the same in the lateral direction. The left-side cam 52L includes a coupling connection-disconnection mechanism 50 and a contact-separation mechanism 61.

The coupling connection-disconnection mechanism 50 serves to connect and disconnect each developing-coupling male assembly 32 relative to the corresponding developing-coupling female member 23. Specifically, a flat plate-like shaped portion of the left-side cam 52L serves as the coupling connection-disconnection mechanism 50. The coupling connection-disconnection mechanism 50 includes four developing-coupling penetration holes 54, four cam portions 56 and a drum-coupling penetration hole 55.

The four developing-coupling penetration holes 54 are formed on an upper end portion of the coupling connection-disconnection mechanism 50 such that the developing-coupling penetration holes 54 are arranged in the front-to-rear direction and spaced away from one another. Each developing-coupling penetration hole 54 is a through-hole having a generally elongated shaped side view extending in the front-to-rear direction.

Each developing-coupling penetration hole 54 has a length in a top-to-bottom direction longer than an outer diameter of the movable shaft 37 (precisely, an outer diameter of a portion of the movable shaft 37, the portion occupying rightward of the flange portion 35) of each developing-coupling male assembly 32, but shorter than an outer diameter of the flange portion 35 of each developing-coupling male assembly 32.

Each cam portion 56 protrudes leftward from a peripheral end portion of each developing-coupling penetration hole 54, more precisely, from a rear half portion of the peripheral end portion of each developing-coupling penetration hole 54. The cam portion 56 therefore has a generally U-shape in a left side view which is open frontward. The cam portion 56 positioned rearmost has a length shorter than those of the remaining three cam portions 56 in the front-to-rear direction, as shown in FIGS. 2 and 3.

Each cam portion 56 includes a displacing portion 57 and a maintaining portion 58.

The displacing portion 57 occupies a front end portion of the cam portion 56. The displacing portion 57 has a protruding length (a length from a left surface of the left-side cam 52L) in the lateral direction that becomes gradually longer as approaches rearward. That is, the displacing portion 57 has a front end face 59 sloping leftward as extending rearward (see FIGS. 2 and 3) in a top view.

The maintaining portion 58 extends rearward from a rear end portion of the displacing portion 57. The maintaining portion 58 has a flat left end face 60 connected from the front end face 59 and extending linearly in the front-to-rear direction.

The drum-coupling penetration hole 55 is disposed below the developing-coupling penetration holes 54 (at a position generally center of the coupling connection-disconnection mechanism 50 in the top-to-bottom direction). The drum-coupling penetration hole 55 is a through-hole having an elongated shaped side view extending in the front-to-rear direction. The drum-coupling penetration hole 55 has such a length in the front-to-rear direction that all the drum-coupling male members 33 can be integrally accommodated therewithin to penetrate therethrough.

The contact-separation mechanism 61 is formed to be continuous with a bottom end portion of the coupling connection-disconnection mechanism 50 such that the contact-separation mechanism 61 is positioned below left end portions of the drum cartridges 17. As shown in FIGS. 2 and 3, the contact-separation mechanism 61 has a generally rectangular columnar shape extending in the front-to-rear direction. The contact-separation mechanism 61 has a length in the front-to-rear direction longer than that of the coupling connection-disconnection mechanism 50. Further, the contact-separation mechanism 61 has a length (thickness) in the lateral direction longer than that of the coupling connection-disconnection mechanism 50. That is, the contact-separation mechanism 61 has a right end portion that is positioned rightward than a right end surface of the coupling connection-disconnection mechanism 50.

The contact-separation mechanism 61 includes a rack portion 62 (see FIG. 2) and four engaging grooves 63 (see FIG. 3).

The rack portion 62 is formed on a lower surface of a front end portion of the contact-separation mechanism 61. The rack portion 62 is formed to extend in the front-to-rear direction, serving as gear teeth of a liner gear on the left side (i.e., the left-side cam 52L).

The four engaging grooves 63 are formed on the right end portion of the contact-separation mechanism 61 such that each engaging groove 63 is positioned frontward of each developing-coupling penetration hole 54. Each engaging groove 63 extends generally downward from an upper peripheral edge of the right end portion of the contact-separation mechanism 61 to provide a generally U-shaped side view whose open end is oriented upward. Specifically, each engaging groove 63 has an upper end portion which is slightly sloped diagonally upward and rearward (refer to a shape of each engaging groove 72 shown in FIGS. 2 and 4). Each engaging groove 63 has a width in the front-to-rear direction larger than an outer diameter of an engaging protrusion 90 (described later) of each second separation member 82, which is configured to be engaged with the engaging groove 63 as will be described later. The second separation member 82 can therefore be received in the engaging groove 63.

Referring to FIG. 4, the right-side cam 52R has a shape identical to that of the contact-separation mechanism 61, and disposed below right end portions of the drum cartridges 17. More specifically, the right-side cam 52R has a generally prismatic columnar shape extending in the front-to-rear direction. The right-side cam 52R includes a rack portion 71 and four engaging grooves 72.

Just like the rack portion 62 of the left-side cam 52L, the rack portion 71 is formed on a lower surface of a front end portion of the right-side cam 52R. The rack portion 71 is formed to extend in the front-to-rear direction, serving as gear teeth of a liner gear on the right side (right-side cam 52R).

The four engaging groove 72 are formed on a left end portion of the right-side cam 52R. Specifically, the four engaging grooves 72 are juxtaposedly arranged in the front-to-rear direction and spaced away from one another such that each engaging groove 72 is positioned to be coincident with each engaging groove 63 of the left-side cam 52L when projected in the lateral direction. Just like the engaging grooves 63, each engaging groove 72 extends generally downward from an upper peripheral edge of the left end portion of the right-side cam 52R to provide a generally U-shaped side view whose open end is oriented upward. Each engaging groove 72 has a width in the front-to-rear direction larger than an outer diameter of the engaging protrusion 90 (described later) of each second separation member 82, which is configured to be engaged with the engaging groove 72, as will be described later. The second separation member 82 can therefore be received in the engaging groove 72.

The rearmost engaging groove 72 and the rearmost engaging groove 63 are respectively formed with sliding grooves 64 (refer to FIGS. 3 and 4). The sliding groove 64 extends rearward from the rearmost engaging grooves 72 (or from the rearmost engaging groove 63) at a position midway thereof in the top-to-bottom direction. The sliding groove 64 has a rear end portion bending upward and being open upward. The sliding groove 64 has a width in the top-to-bottom direction larger than the outer diameter of the engaging protrusion 90 (described later) of the corresponding second separation member 82 such that the second separation member 82 is slidable along the sliding groove 64.

The second separation members 82 function to separate the developing cartridges 7 from the corresponding photosensitive drums 5 in conjunction with the first separation members 81. The second separation members 82 are disposed such that each second separation member 82 is positioned frontward and downward of each first separation member 81 provided on each drum cartridge 17. Each second separation member 82 integrally includes a supported portion 86, an engaging portion 87 and a pressing portion 88.

Referring to FIG. 4, the supported portion 86 has a generally circular plate-like shape having a certain thickness in the lateral direction. The supported portion 86 has a laterally inner surface from which a generally columnar-shaped pivot shaft 89 extend laterally inward such that the pivot shaft 89 is coaxially positioned relative to the supported portion 86. That is, the supported portion 86 and the pivot shaft 89 shares an axis common to each other extending in the lateral direction. Each second separation member 82 is supported within the main casing 2 such that the second separation member 82 is pivotally movable about the axis of the pivot shaft 89.

The engaging portion 87 extends generally downward from the supported portion 86 and is formed in a generally beam-like shape. The engaging portion 87 has a bottom end portion on which the engaging protrusion 90 is formed.

Specifically, the engaging portion 87 has a generally columnar shape and protrudes laterally outward from a laterally outer surface of the bottom end portion of the engaging portion 87.

The pressing portion 88 extends generally upward from the supported portion 86 and is formed in a generally beam-like shape. The pressing portion 88 has an upper end portion which is configured to be engaged with the lower end portion of the contact portion 84 of the corresponding first separation member 81.

Each second separation member 82 is pivotally movably supported within the main casing 2 such that the bottom end portion of the engaging portion 87 (the engaging protrusion 90) is in direct confrontation with an upper surface of the contact-separation mechanism 61 of the left-side cam 52L (or an upper surface of the right-side cam 52R), and the upper end portion of the pressing portion 88 confronts the lower end portion of the contact portion 84 of the corresponding first separation member 81 from frontward and upward thereof.

Specifically, the second separation member 82 is pivotally movable, about the axis of the pivot shaft 89, between a pressing position (see FIG. 4) where the pressing portion 88 is in abutment with the contact portion 84 of the corresponding first separation member 81 to push the same downward and rearward, and a pressing-releasing position (see FIG. 12) where the pressing portion 88 is retracted upward and frontward from the contact portion 84 of the corresponding first separation member 81 to release the same from being pushed. Each second separation member 82 is biased in a clockwise direction in a left side view to be normally at the pressing-releasing position, due to a biasing member (not shown), such as a coil spring.

The driving-force transmission shaft 53 functions to transmit the driving force simultaneously to both of the linearly movable cams 52. The driving-force transmission shaft 53 is fixedly positioned downward of the front end portions of both linearly movable cams 52 (the left-side cam 52L and the right-side cam 52R) so as to be in meshing engagement with both the rack portions 62 and the rack portion 71 simultaneously, as shown in FIG. 2.

Specifically, the driving-force transmission shaft 53 includes a shaft 76 and a pair of pinion gears 77.

The shaft 76 has a generally columnar shape extending in the lateral direction. The shaft 76 has a left end portion positioned below the rack portion 62 of the left-side cam 52L to confront the same, and a right end portion positioned below the rack portion 71 of the right-side cam 52R to confront the same. Each pinion gear 77 is provided at each lateral end portion (the right and left end portions) of the shaft 76 such that the pinion gears 77 do not rotate relative to the shaft 76. The pinion gear 77 provided on the left side is in meshing engagement with the rack portion 62 of the left-side cam 52L, while the pinion gear 77 provided on the right side is in meshing engagement with the rack portion 71 of the right-side cam 52R.

The cam mechanism 51 (the linearly movable cams 52, the second separation members 82 and the driving-force transmission shaft 53 in conjunction with one another) can be displaced (movable) among a first position (FIG. 12), a second position (FIG. 8) and a third position (FIG. 4). In the first position, the pinion gears 77 are in meshing engagement with front end portions of the rack portions 62, 71 respectively. In the second position, the pinion gears 77 are respectively in meshing engagement with center portions of the respective rack portions 62, 71 in the front-to-rear direction. In the third position, the pinion gears 77 are in meshing engagement with rear end portions of the rack portions 62, 71 respectively.

5. Switching Operation Mode

The printer 1 according to the present embodiment can switch its operation mode among all-separation mode, monochromatic printing mode and color printing mode.

(1) All-Separation Mode

In the all-separation mode, the printer 1 does not perform image formation. As shown in FIGS. 3 and 4, when the printer 1 is in the all-separation mode, the cam mechanism 51 is at its third position.

The movable shaft 37 of each developing-coupling male assembly 32 is placed at the retracted position, against a biasing force of the biasing member (not shown), since the flange portion 35 of each movable shaft 37 is in abutment with the maintaining portion 58 of the corresponding cam portion 56 of the left-side cam 52L from leftward thereof.

Incidentally, all the developing-coupling female members 23 are disposed rightward of the corresponding developing-coupling male assemblies 32 to oppose the same. In other words, connection between each developing-coupling male assembly 32 and each developing-coupling female member 23 is released when the cam mechanism 51 is at the third position.

Further, at this time, as shown in FIG. 4, each second separation member 82 is placed at its pressing position against a biasing force of the biasing member (not shown), since the engaging protrusion 90 of each second separation member 82 is in abutment with the upper surface of the contact-separation mechanism 61 of the left-side cam 52L (or the upper surface of the right-side cam 52R) at a position rearward of the corresponding engaging groove 63 (or the engaging groove 72). As to the rearmost second separation members 82, precisely, each second separation member 82 is positioned rearward of the corresponding engaging groove 72 and the sliding groove 64.

The pressing portion 88 of each second separation member 82 at its pressing position thus pushes the contact portion 84 of the corresponding first separation member 81 downward and rearward, thereby pivotally moving the first separation member 81 to the pushing position.

As a result, the pressing portion 85 of each first separation member 81 is brought into contact with the abutment portion 27 of the corresponding developing cartridge 7 and pushes the same upward and frontward. Each developing cartridge 7 is therefore separated upward and frontward from the corresponding photosensitive drum 5.

When the motor 100 is driven, each drum-coupling male member 33 is rotated in the clockwise direction and each developing-coupling male assembly 32 is also rotated in the clockwise direction in a left side view.

As the drum-coupling male members 33 rotate, each photosensitive drum 5 is in receipt of the driving force from the drum-coupling male members 33 via the corresponding drum-coupling female members (not shown), thereby rotating all the photosensitive drums 5.

Meanwhile, since connection between each developing-coupling male assembly 32 and each developing-coupling female member 23 is released as explained above, the driving force from the motor 100 is not transmitted to the developing-coupling female members 23. The developing rollers 9 are therefore not rotated.

As a result, toner is not supplied from the developing roller 9 to the photosensitive drum 5. A toner image is not formed on the outer peripheral surface of the photosensitive drum 5. In other words, in the all-separation mode, image formation cannot be performed.

(2) Monochromatic Printing Mode

In the monochromatic printing mode, the printer 1 forms monochromatic images on the sheets S. In order to switch the operation mode from the all-separation mode to the monochromatic printing mode, the driving-force transmission shaft 53 is rotated in a counterclockwise direction in a left side view to move both linearly movable cams 52 (the left-side cam 52L and the right-side cam 52R) rearward.

Figure 5:
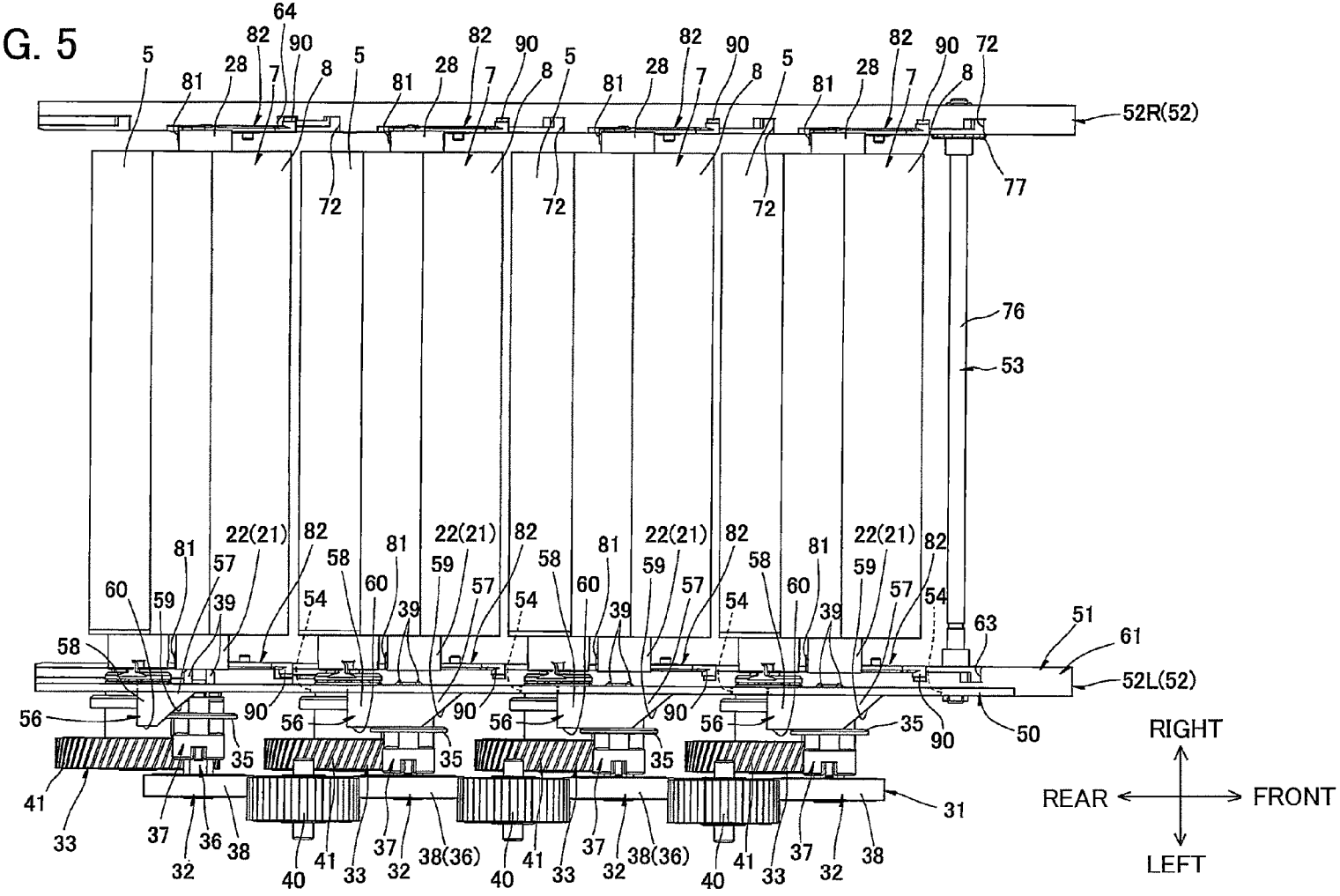
FIG. 5 is a plan view of the driving-force inputting unit of FIG. 2, wherein the driving-force inputting unit is being switched from the all-separation mode to a monochromatic printing mode.

In accordance with this rearward movement of the linearly movable cams 52, as shown in FIG. 5, the flange portion 35 of the rearmost developing-coupling male assembly 32 (for the color of black) is moved frontward relative to the cam portion 56 for black such that the flange portion 35 confronts the displacing portion 57 of the cam portion 56. Then, due to the biasing force of the biasing member (not shown), the movable shaft 37 of the developing-coupling male assembly 32 is caused to move along the front end face 59 of the displacing portion 57 toward the advanced position from the retracted position.

As a result, only tip end portions (right end portions) of the coupling protrusions 39 of the movable shaft 37 of the developing-coupling male assembly 32 are coupled to the corresponding coupling recesses 24 of the developing-coupling female member 23. The developing-coupling male assembly 32 for black is thus slightly connected to the developing-coupling female member 23 for black.

If the motor 100 is driven at this time, the tip end portion of each coupling protrusion 39 is brought into abutment with the end face 25 of the corresponding coupling recess 24. The driving force is transmitted to the developing-coupling female member 23 from the developing-coupling male assembly 32, thereby rotating the developing roller 9 of the black developing cartridge 7.

Figure 6:
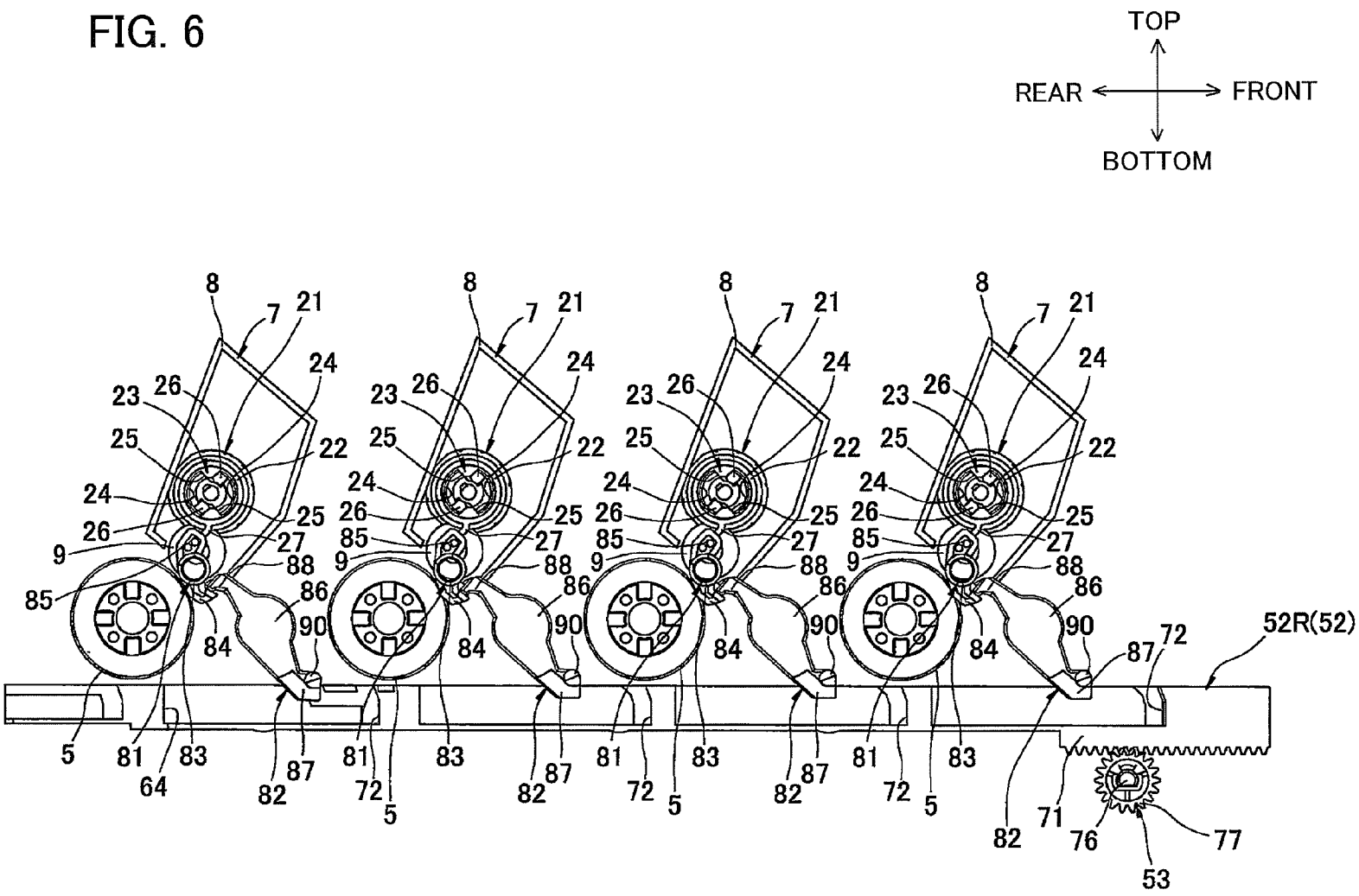
FIG. 6 is a side cross-sectional view of the driving-force inputting unit of FIG. 2, wherein the driving-force inputting unit is being switched from the all-separation mode to a monochromatic printing mode.

Meanwhile, all the second separation members 82 are placed at the pressing position against the biasing force of the biasing member (not shown), as shown in FIG. 6. This means that all the first separation members 81 are at the pushing position, and all the developing cartridges 7 are separated upward and frontward from the respective photosensitive drums 5.

That is, the developing roller 9 of the black developing cartridge 7 is rotating, while disposed in opposition to the black photosensitive drum 5 and separated upward and frontward therefrom. Incidentally, at this time, the movable shaft 37 of the developing-coupling male assembly 32 for black is connected to the developing-coupling female member 23 for black in a state where the right end portion of the movable shaft 37 is pivotally moved slightly frontward and rearward.

Figure 7:
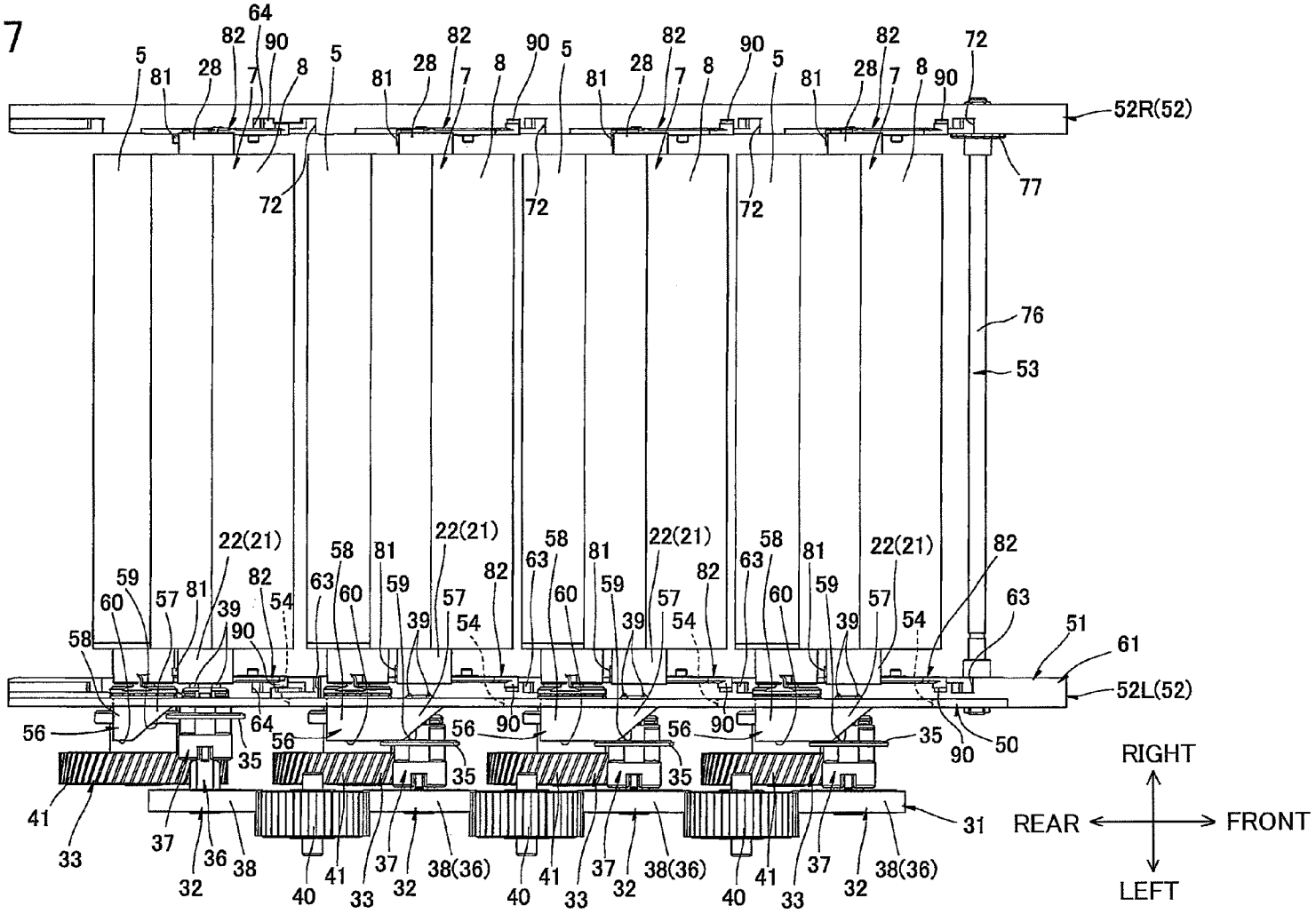
FIG. 7 is a plan view of the driving-force inputting unit of FIG. 2, wherein the driving-force inputting unit is in the monochromatic printing mode.

As the driving-force transmission shaft 53 is further rotated in the counterclockwise direction in FIG. 6 to move the linearly movable cams 52 further rearward, the cam mechanism 51 is moved to the second position. The flange portion 35 of the black (rearmost) developing-coupling male assembly 32 is therefore positioned frontward of the displacing portion 57 of the corresponding cam portion 56, thereby permitting the movable shaft 37 of the black developing-coupling male assembly 32 to move to the advanced position, as shown in FIG. 7.

As a result, the coupling protrusions 39 of the movable shaft 37 of the black developing-coupling male assembly 32 are substantially completely coupled to (received within) the coupling recesses 24 of the black developing-coupling female member 23. The black developing-coupling male assembly 32 is thus completely coupled to the black developing-coupling female member 23.

Incidentally, the movable shafts 37 of the color developing-coupling male assemblies 32 (three developing-coupling male assemblies 32 other than black developing-coupling male assembly 32) are respectively positioned at the retracted position, as in the all-separation mode. That is, the color developing-coupling male assemblies 32 are not connected to the respective color developing-coupling female members 23.

Figure 8:
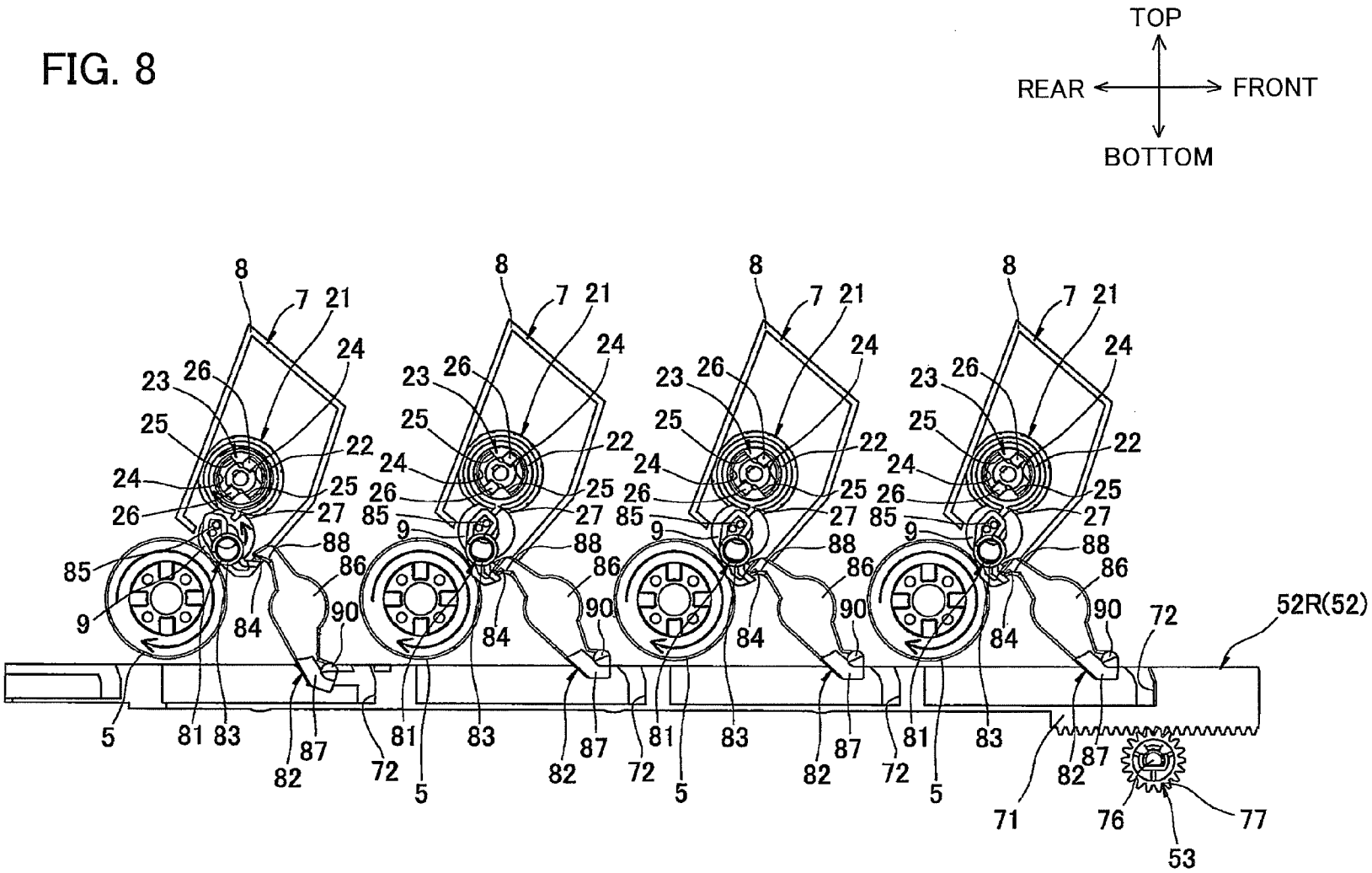
FIG. 8 is a side cross-sectional view of the driving-force inputting unit of FIG. 2, wherein the driving-force inputting unit is in the monochromatic printing mode.

At this time, as shown in FIG. 8, the engaging protrusion 90 of each second separation member 82 corresponding to the black developing cartridge 7 is received by the corresponding sliding groove 64 (accommodated within the rear end portion of the corresponding sliding groove 64) such that each second separation member 82 is pivotally moved in the clockwise direction in a left side view due to the biasing force of the biasing member (not shown), thereby moving the second separation member 82 to the pressing-releasing position.

The second separation members 82 for black at the pressing-releasing position stop pressing the contact portions 84 of the first separation members 81 for the black developing cartridge 7, thereby moving the first separation members 81 to the releasing position (see FIG. 8). The first separation members 81 at the releasing position stop pushing the abutment portions 27 of the black developing cartridge 7. The black developing cartridge 7 is therefore brought into contact with the black photosensitive drum 5 at a position rearward and frontward thereof.

On the other hand, the color developing cartridges 7 remain separated upward and frontward from the respective photosensitive drums 5, as in the all-separation mode, since the first separation members 81 for each color developing cartridge 7 are still at the pushing position (the corresponding second separation members 82 are at the pressing position).

With this construction, toner is supplied to the black photosensitive drum 5 from the black developing cartridge 7 to form a black toner image on the black photosensitive drum 5. However, toner is not supplied to the color photosensitive drums 5 from the color developing cartridges 7 as in the all-separation mode. No toner image is therefore formed on the color photosensitive drums 5. That is, in the monochromatic printing mode, only monochromatic images are formed on the sheets S.

(3) Color Printing Mode

In the color printing mode, the printer 1 forms colored images on the sheets S. In order to switch the operation mode from the monochromatic printing mode to the color printing mode, the driving-force transmission shaft 53 is further rotated in the counterclockwise direction in a left side view to move both of the linearly movable cams 52 (the left-side cam 52L and the right-side cam 52R) further rearward.

As the linearly movable cams 52 move further rearward, the flange portions 35 of the color developing-coupling male assemblies 32 are moved to face the displacing portions 57 of the corresponding cam portions 56. Due to the biasing force of the biasing members (not shown), the movable shafts 37 of the color developing-coupling male assemblies 32 are then caused to move along the front end faces 59 of the respective displacing portions 57 toward the advanced position from the retracted position.

As a result, only tip end portions (right end portions) of the color developing-coupling male assemblies 32 are coupled to (received within) the corresponding coupling recesses 24 of the color developing-coupling female members 23, thereby rendering the color developing-coupling male assemblies 32 slightly connected to the corresponding color developing-coupling female members 23.

If the motor 100 is driven at this time, the tip end portion of each coupling protrusion 39 is brought into abutment with the end face 25 of the corresponding coupling recess 24. The driving force is therefore transmitted to the color developing-coupling female members 23 from the color developing-coupling male assemblies 32, thereby rotating the developing rollers 9 of the color developing cartridges 7.

Figure 10:
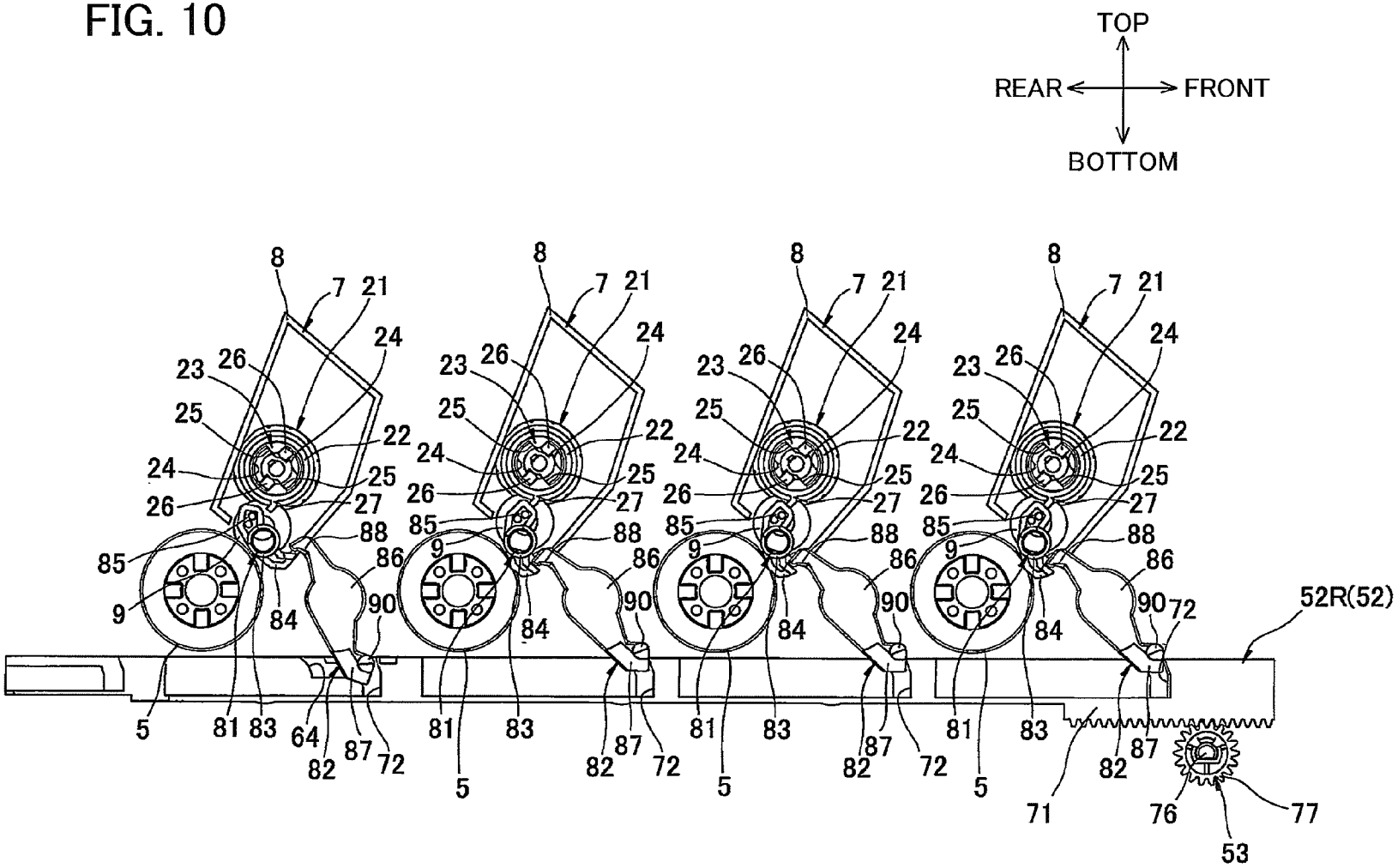
FIG. 10 is a side cross-sectional view of the driving-force inputting unit of FIG. 2, wherein the driving-force inputting unit is being switched from the monochromatic printing mode to the color printing mode.

Meanwhile, as shown in FIG. 10, the second separation members 82 provided for the color developing cartridges 7 are at the pressing position against the biasing force of the biasing member (not shown). Therefore, the first separation members 81 of the color developing cartridges 7 are being pushed upward and frontward to permit the color developing rollers 9 to be separated from the corresponding photosensitive drums 5.

In other words, the color developing rollers 9 are rotating, but remain separated upward and frontward from the corresponding color photosensitive drums 5. Incidentally, at this time, the movable shafts 37 of the color developing-coupling male assemblies 32 are connected to the color developing-coupling female members 23 in a state where the right end portions of the movable shafts 37 are pivotally moved slightly frontward and rearward.

Figure 11:
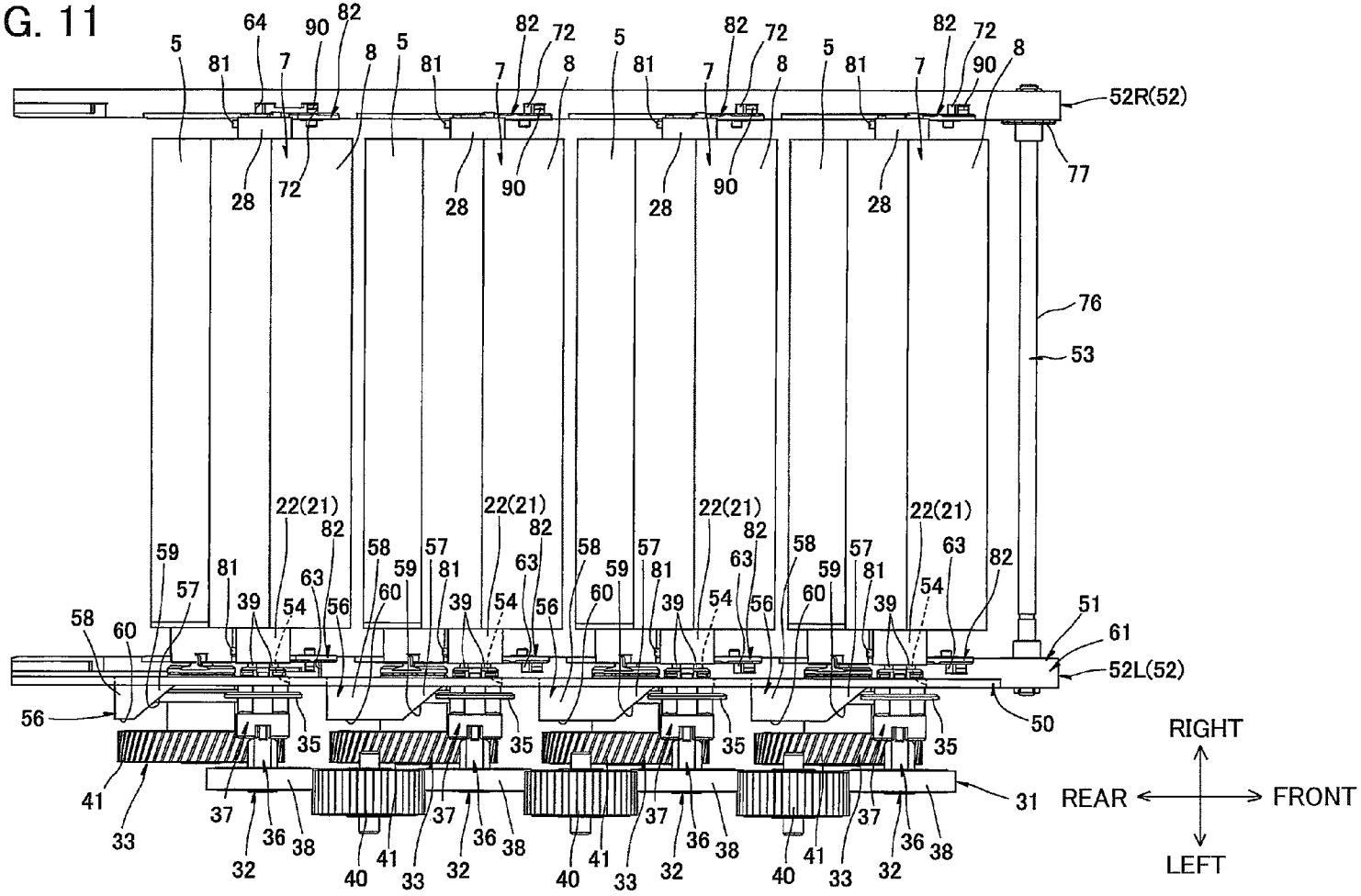
FIG. 11 is a plan view of the driving-force inputting unit of FIG. 2, wherein the driving-force inputting unit is in the color printing mode.

As the driving-force transmission shaft 53 is further rotated in the counterclockwise direction to move the linearly movable cams 52 further rearward, the cam mechanism 51 is moved to the first position as shown in FIG. 11. As a result, the flange portions 35 of the color developing-coupling male assemblies 32 are positioned frontward of the displacing portions 57 of the corresponding cam portions 56. The movable shafts 37 of the color developing-coupling male assemblies 32 are therefore displaced to the advanced position.

The coupling protrusions 39 of each movable shaft 37 are substantially coupled to (accommodated within) the corresponding coupling recesses 24, thereby achieving complete connection between the color developing-coupling male assemblies 32 and the color developing-coupling female members 23.

Figure 12:
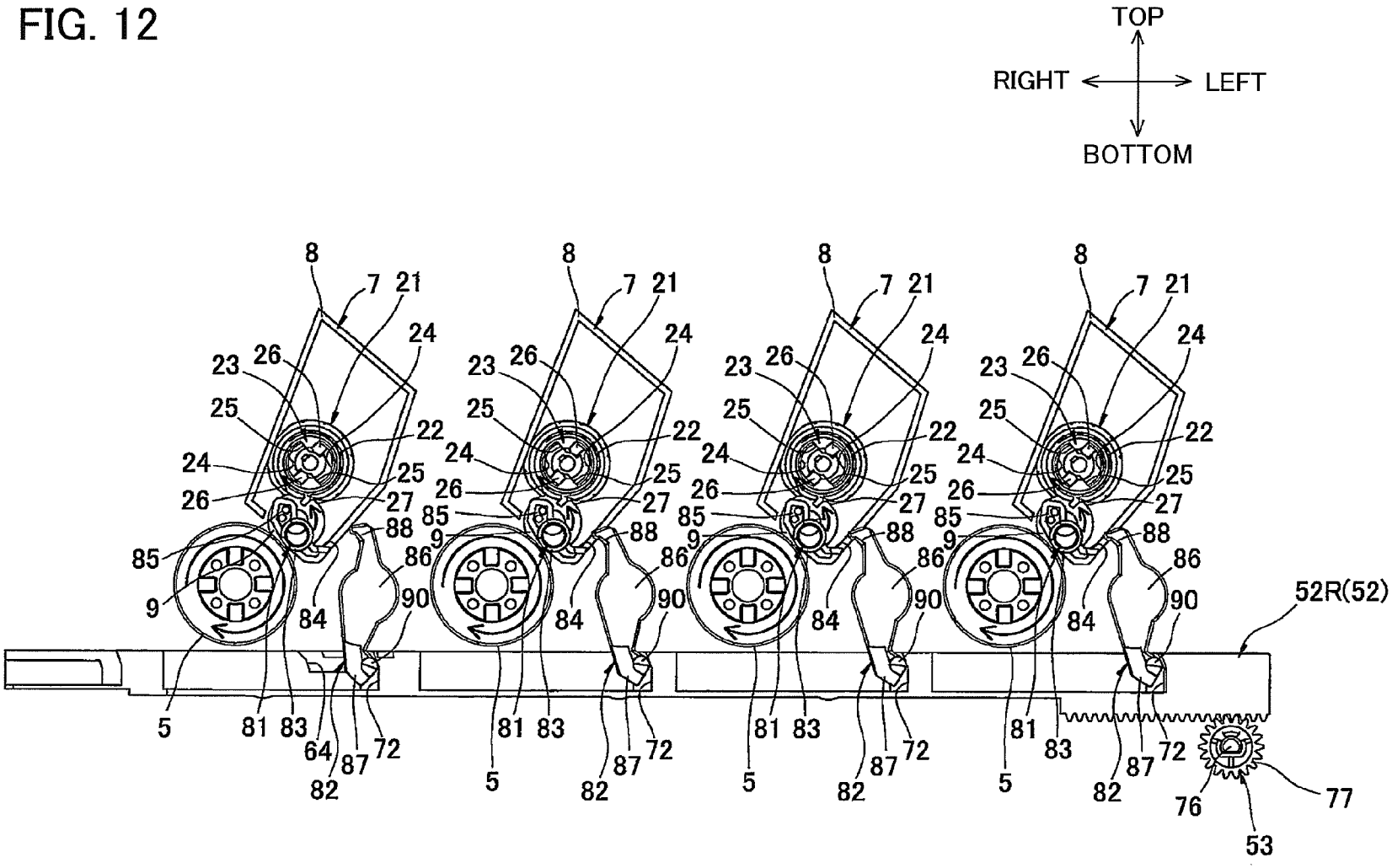
FIG. 12 is a side cross-sectional view of the driving-force inputting unit of FIG. 2, wherein the driving-force inputting unit is in the color printing mode.

Incidentally, as shown in FIG. 12, the second separation members 82 provided for the color developing cartridges 7 are pivotally moved clockwise in a left side view, due to the biasing force of the biasing members (not shown), such that the engaging protrusion 90 of each second separation member 82 is received by and coupled to the corresponding engaging groove 63 (or the engaging groove 72) to bring the second separation members 82 to the pressing-releasing position.

That is, the pressing portion 88 of each second separation member 82 stops pressing the contact portion 84 of the corresponding first separation member 81 downward and rearward, thereby causing each first separation member 81 to pivotally move counterclockwise to be at the releasing position.

The first separation members 81 at the releasing position thus stop pushing the corresponding abutment portions 27 of the color developing cartridges 7, thereby permitting the developing rollers 9 of the color developing cartridges 7 to be in contact with the corresponding photosensitive drums 5 from upward and frontward thereof.

In this way, all the developing cartridges 7 are in contact with the corresponding photosensitive drums 5 from upward and frontward thereof such that toner can be supplied from all the developing rollers 9 to the corresponding photosensitive drums 5. That is, toner images are formed on all of the photosensitive drums 5. Color images are thus formed on the sheets S during the color printing mode.

(4) Switching Operation Mode from Color Printing Mode

For switching from the color printing mode to the monochromatic printing mode or the all-separation mode, the linearly movable cams 52 are moved in a direction opposite to that in the above-described switching operations (1)-(3). That is, the driving-force transmission shaft 53 is rotated clockwise in a left side view to move the linearly movable cams 52 frontward.

Figure 9:
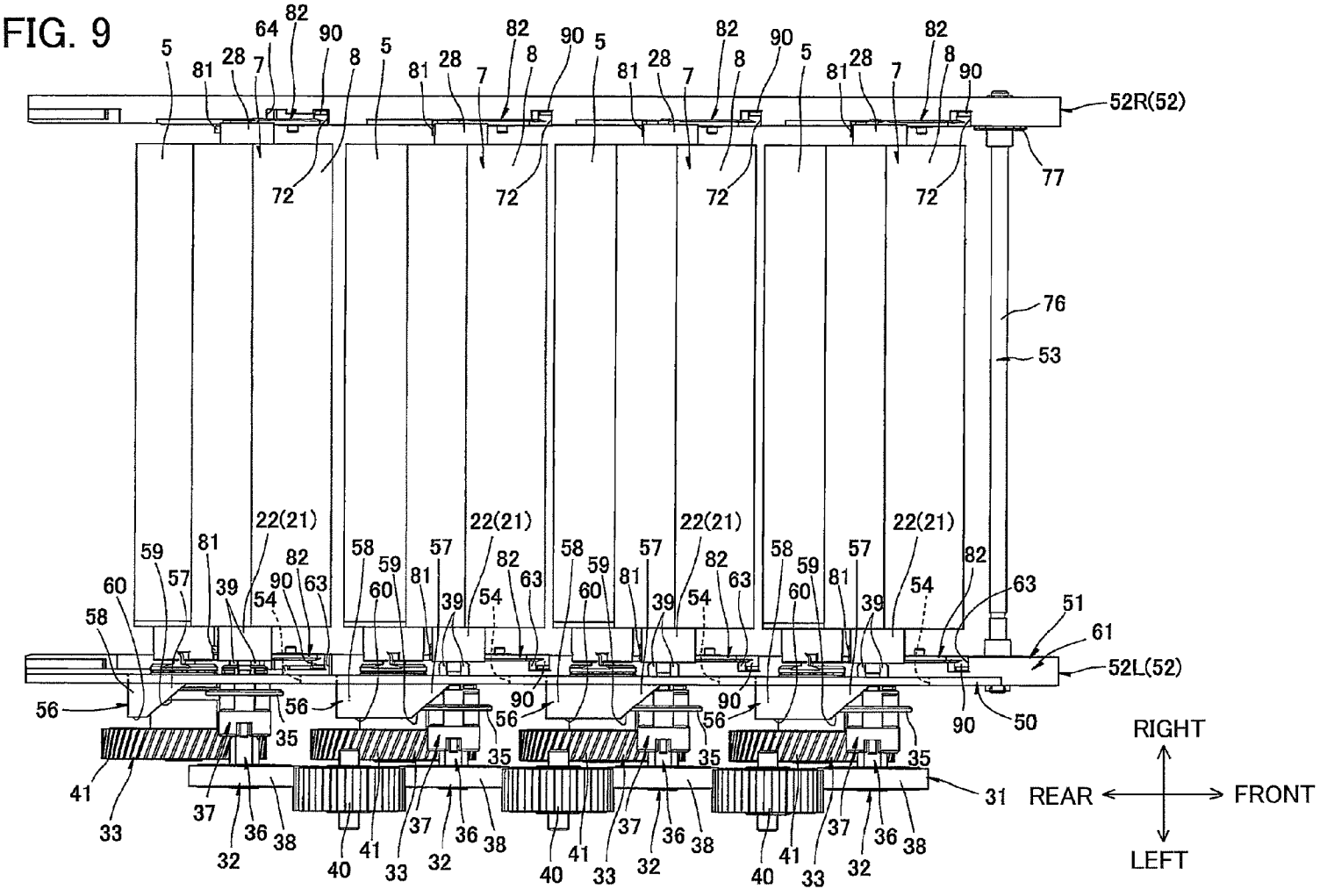
FIG. 9 is a plan view of the driving-force inputting unit of FIG. 2, wherein the driving-force inputting unit is being switched from the monochromatic printing mode to a color printing mode.

Then, as shown in FIGS. 9 and 10, during a process in which the operation mode is switched from the color printing mode to the monochromatic printing mode, the color developing rollers 9 are rotating, but are displaced upward and frontward of the corresponding color photosensitive drums 5 to be spaced away from the same.

Subsequently, as shown in FIGS. 7 and 8, transmission of the driving force to the color developing cartridges 7 is terminated. That is, the cam mechanism 51 is moved to the second position after the color developing rollers 9 are separated from the respective color photosensitive drums 5.

When the operation mode is further switched from the monochromatic printing mode to the all-separation mode, as shown in FIGS. 5 and 6, the black developing roller 9 is rotating but is displaced upward and frontward of the black photosensitive drum 5 so as to be spaced away from the same.

Subsequently, as shown in FIGS. 3 and 4, transmission of the driving force to the black developing cartridge 7 is stopped. In other words, the cam mechanism 51 is moved to the third position after the black developing roller 9 is separated from the black photosensitive drum 5.

Switching among the all-separation mode, the monochromatic printing mode and the color printing mode is thus realized by the linear movement of the linearly movable cams 52 in the front-to-rear direction.

6. Advantageous Effects (1) According to the printer 1 of the present embodiment, the driving force can be transmitted to all the developing rollers 9 when the cam mechanism 51 is at the first position, as shown in FIG. 11, whereas the driving force is transmitted only to the black developing roller 9 when the cam mechanism 51 is displaced to the second position, as shown in FIG. 7.

With this structure, linear movement of the cam mechanism 51 can realize connection and disconnection between the developing-coupling male assemblies 32 and the developing-coupling female members 23 for switching the operation mode between the color printing mode and the monochromatic printing mode.

(2) According to the printer 1 of the present embodiment, the color developing rollers 9 are permitted to stop rotating while being separated from the color photosensitive drums 5, as shown in FIG. 8.

Therefore, since the color developing rollers 9 do not rotate following rotation of the corresponding color photosensitive drums 5, sliding contact between the color developing rollers 9 and the color photosensitive drums 5 is reduced, thereby serving to suppress deterioration of the color developing rollers 9 and the color photosensitive drums 5.

(3) Further, according to the printer 1 of the present invention, during switching from the color printing mode to the monochromatic printing mode, the color developing rollers 9 are caused to stop rotating (see FIGS. 7 and 8) after being separated from the color photosensitive drums 5 (see FIGS. 9 and 10).

With this structure, compared to a case where the color developing rollers 9 are separated from the color photosensitive drums 5 after stopping rotating, an increase in attrition resistance between the color developing rollers 9 and the color photosensitive drums 5 can be suppressed, since difference in circumferential speed therebetween can be reduced.

As a result, deterioration of the color developing rollers 9 and the color photosensitive drums 5 attributed to sliding contact therebetween can be further suppressed.

(4) According to the printer 1 of the present embodiment, connection and disconnection between each developing-coupling male assembly 32 and each developing-coupling female member 23 can be achieved by movement of the left-side cam 52L in the front-to-rear direction, as shown in FIGS. 3, 7 and 11.

Such simple structure of the present embodiment allows the operation mode (the all-separation mode, the monochromatic printing mode and the color printing mode) to be switched from one another, compared to a case where a mechanism for connecting and disconnecting the black developing-coupling male assembly 32 relative to the black developing-coupling female member 23 is provided separately from a mechanism for connecting and disconnecting the color developing-coupling male assemblies 32 relative to the color developing-coupling female members 23.

(5) According to the printer 1 of the present embodiment, the left-side cam 52L (the contact-separation mechanism 61 of the left-side cam 52L) functions to realize contact and separation of the developing cartridges 7 relative to the photosensitive drums 5. The left-side cam 52L also functions to realize connection and disconnection of the developing-coupling male assemblies 32 relative to the developing-coupling female members 23.

The cam mechanism 51 thus requires a smaller number of parts.

(6) The printer 1 of the present invention is switchable to the all-separation mode in which all the developing rollers 9 are prevented from rotating, as shown in FIGS. 3 and 4.

All the developing rollers 9 are separated from the corresponding photosensitive drums 5 such that the developing rollers 9 do not rotate following rotation of the photosensitive drums 5. Therefore, sliding contact between the developing rollers 9 and the photosensitive drums 5 is reduced, thereby suppressing deterioration of the developing rollers 9 and the photosensitive drums 5.

(7) According to the printer 1 of the present invention, when the operation mode is being switched from the monochromatic printing mode to the all-separation mode (see FIGS. 4 and 6), the black developing roller 9 is configured to stop rotating after separated from the black photosensitive drum 5 (see FIGS. 3 and 5).

Therefore, as in case of the color developing rollers 9, the black developing roller 9 can be prevented from being rotated following rotation of the black photosensitive drums 5 in a state where the black developing roller 9 is stopped driving, since the black developing roller 9 is first separated from the black photosensitive drum 5. Sliding contact between the black developing roller 9 and the black photosensitive drum 5 can be thus reduced, thereby further suppressing deterioration of the black developing roller 9 and the black photosensitive drum 5.

(8) According to the printer 1 of the present embodiment, the black developing roller 9 can be separated from the black photosensitive drum 5 (FIG. 6) in a state where the black developing-coupling male assembly 32 is connected to the black developing-coupling female member 23 (FIG. 5).

Further, the color developing rollers 9 can also be separated from the color photosensitive drums 5 (FIG. 10) in a state where the color developing rollers 9 are connected to the corresponding color photosensitive drums 5 (FIG. 9).

(9) According to the printer 1 of the present embodiment, all the developing-coupling male assemblies 32 can be driven by the common motor 100, as shown in FIG. 2. The structure of the printer 1 can be simplified.

(10) According to the printer 1 of the present embodiment, all the photosensitive drums 5 can be driven also by the motor 100, as shown in FIG. 2. Further simplified structure can be realized in the printer 1.

While the invention has been described in detail with reference to the embodiments thereof, it would be apparent to those skilled in the art that various changes and modifications may be made therein without departing from the spirit of the invention.

What is claimed is:

1. An image forming apparatus comprising:

a first photosensitive drum;

a first drum coupling configured to receive a first drum driving force therein and transmit the first drum driving force to the first photosensitive drum;

a first developing roller configured to be in contact with the first photosensitive drum, the first developing roller defining a first axis extending in an axial direction;

a first driving-force inputting section configured to receive a first developing-roller driving force therein and transmit the first developing-roller driving force to the first developing roller;

a first developing coupling connectable to the first driving-force inputting section for transmitting the first developing-roller driving force thereto, the first developing coupling being a separate member from the first drum coupling;

a second photosensitive drum;

a second drum coupling configured to receive a second drum driving force therein and transmit the second drum driving force to the second photosensitive drum;

a second developing roller configured to be in contact with the second photosensitive drum, the second developing roller defining a second axis extending in the axial direction;

a second driving-force inputting section configured to receive a second developing-roller driving force therein and transmit the second developing-roller driving force to the second developing roller;

a second developing coupling connectable to the second driving-force inputting section for transmitting the second developing-roller driving force thereto, the second developing coupling being a separate member from the second drum coupling; and a connecting mechanism configured to move the first developing coupling in the axial direction to permit the first developing coupling to be connected to and disconnected from the first driving-force inputting section, and configured to move the second developing coupling in the axial direction to permit the second developing coupling to be connected to and disconnected from the second driving-force inputting section, wherein the connecting mechanism comprises a movable member configured to linearly move in a predetermined direction perpendicular to the axial direction, the movable member including a first cam portion configured to contact the first developing coupling and a second cam portion configured to contact the second developing coupling, and wherein the movable member of the connecting mechanism is configured to move between a first position and a third position via a second position, the movable member at the first position causing the first developing coupling and the second developing coupling to be connected to the first driving-force inputting section and the second driving-force inputting section respectively, the movable member at the second position causing the first developing coupling to be connected to the first driving-force inputting section but causing the second developing coupling to be disconnected from the second driving-force inputting section, the movable member at the third position causing the first developing coupling and the second developing coupling to be disconnected from the first driving-force inputting section and the second driving-force inputting section, respectively, and wherein the movable member comprises a drum-coupling penetration hole and a first developing-coupling penetration hole around which the first cam portion is disposed and a second developing-coupling penetration hole around which the second cam portion is disposed, the first drum coupling and the second drum coupling penetrating through the drum-coupling penetration hole, the first developing coupling penetrating through the first developing-coupling penetration hole and the second developing coupling penetrating through the second developing-coupling penetration hole such that the movable member linearly moves in the predetermined direction to move the first developing coupling by the first cam portion and the second developing coupling by the second cam portion without moving the first drum coupling and the second drum coupling.

2. The image forming apparatus according to claim 1, further comprising a contact-separation mechanism configured to move the second developing roller relative to the second photosensitive drum;

wherein the contact-separation mechanism is configured to permit the second developing roller to be in contact with the second photosensitive drum when the movable member of the connecting mechanism is at the first position, and to permit the second developing roller to be separated from the second photosensitive drum when the movable member of the connecting mechanism is at the second position.

3. The image forming apparatus according to claim 2, wherein the connecting mechanism and the contact-separation mechanism are configured such that the movable member of the connecting mechanism is moved to the second position after the contact-separation mechanism separates the second developing roller from the second photosensitive drum.

4. The image forming apparatus according to claim 2, wherein the first photosensitive drum and the second photosensitive drum are juxtaposedly arrayed in the predetermined direction; and wherein the movable member of the connecting mechanism is movable between the first position and third position via the second position in accordance with the linear movement of the movable member in the predetermined direction.

5. The image forming apparatus according to claim 4, wherein the predetermined direction includes a first direction and a second direction opposite thereto; and wherein the movable member of the connecting mechanism is moved from the first position to the second position when the movable member is moved in the first direction, and wherein the movable member of the connecting mechanism is moved from the second position to the first position when the movable member is moved in the second direction.

6. The image forming apparatus according to claim 5, wherein the movable member has a portion functioning as one of constituents of the contact-separation mechanism such that the movement of the movable member in the predetermined direction causes the second developing roller to move relative to the second photosensitive drum.

7. The image forming apparatus according to claim 2, wherein the contact-separation mechanism is further configured to move the first developing roller relative to the first photosensitive drum such that the first developing roller is in contact with or in separation from the first photosensitive drum; and wherein the contact-separation mechanism causes the first developing roller and the second developing roller to be separated from the first photosensitive drum and the second photosensitive drum respectively when the movable member of the connecting mechanism is at the third position.

8. The image forming apparatus according to claim 7, wherein the connecting mechanism and the contact-separation mechanism are configured such that the movable member of the connecting mechanism is moved to the third position after the contact-separation mechanism separates the first developing roller and the second developing roller from the first photosensitive drum and the second photosensitive drum respectively.

9. The image forming apparatus according to claim 1, wherein the first developing coupling has a first pivot portion configured to be pivotally movable relative to the first driving-force inputting section in a direction in which the first developing roller contacts with or separates from the first photosensitive drum; and wherein the second developing coupling has a second pivot portion configured to be pivotally movable relative to the second driving-force inputting section in a direction in which the second developing roller contacts with or separates from the second photosensitive drum.

10. The image forming apparatus according to claim 1, further comprising a drive source configured to apply the first developing-roller driving force and the second developing-roller driving force to the first developing coupling and the second developing coupling, respectively.

11. The image forming apparatus according to claim 10, wherein the drive source is further configured to drive the first photosensitive drum and the second photosensitive drum.

12. The image forming apparatus according to claim 1, wherein the second cam portion protrudes from the movable member outward in the axial direction, and the second cam portion comprises:

a sloped portion sloping relative to the predetermined direction; and a maintaining portion extending in the predetermined direction, wherein the second developing coupling comprises a slide portion configured to slide along the sloped portion and the maintaining portion in accordance with the linear movement of the movable member in the predetermined direction to realize connection and disconnection of the second developing coupling relative to the second driving-force inputting section in the axial direction.

13. The image forming apparatus according to claim 12, wherein the second developing coupling is connected to the second driving-force inputting section while the slide portion is on the sloped portion, and wherein the second developing coupling is disconnected from the second driving-force inputting section while the slide portion is on the maintaining portion.

14. An image forming apparatus comprising:

a first photosensitive drum;

a first drum coupling configured to receive a first drum driving force therein and transmit the first drum driving force to the first photosensitive drum;

a first developing roller configured to be in contact with the first photosensitive drum, the first developing roller defining a first axis extending in an axial direction;

a first driving-force inputting section configured to receive a first developing-roller driving force therein and transmit the first developing-roller driving force to the first developing roller;

a first developing coupling connectable to the first driving-force inputting section for transmitting the first developing-roller driving force thereto, the first developing coupling being a separate member from the first drum coupling;

a second photosensitive drum juxtaposedly arrayed with the first photosensitive drum in a predetermined direction perpendicular to the axial direction;

a second drum coupling configured to receive a second drum driving force therein and transmit the second drum driving force to the second photosensitive drum;

a second developing roller configured to be in contact with the second photosensitive drum, the second developing roller defining a second axis extending in the axial direction;

a second driving-force inputting section configured to receive a second developing-roller driving force therein and transmit the second developing-roller driving force to the second developing roller;

a second developing coupling connectable to the second driving-force inputting section for transmitting the second developing-roller driving force thereto, the second developing coupling being a separate member from the second drum coupling;

a movable member configured to move the first developing coupling in the axial direction to permit the first developing coupling to be connected to and disconnected from the first driving-force inputting section, and configured to move the second developing coupling in the axial direction to permit the second developing coupling to be connected to and disconnected from the second driving-force inputting section;

a first cam portion provided on the movable member and configured to contact the first developing coupling; and a second cam portion provided on the movable member and configured to contact the second developing coupling, wherein the movable member is configured to linearly move between a first position and a third position via a second position in the predetermined direction, the movable member at the first position causing the first developing coupling and the second developing coupling to be connected to the first driving-force inputting section and the second driving-force inputting section respectively, and the movable member at the second position causing the first developing coupling to be connected to the first driving-force inputting section but causing the second developing coupling to be disconnected from the second driving-force inputting section, the movable member at the third position causing the first developing coupling and the second developing coupling to be disconnected from the first driving-force inputting section and the second driving-force inputting section, respectively, wherein the movable member comprises a drum-coupling penetration hole and a first developing-coupling penetration hole around which the first cam portion is disposed and a second developing-coupling penetration hole around which the second cam portion is disposed, the first drum coupling and the second drum coupling penetrating through the drum-coupling penetration hole, the first developing coupling penetrating through the first developing-coupling penetration hole and the second developing coupling penetrating through the second developing-coupling penetration hole such that the movable member linearly moves in the predetermined direction to move the first developing coupling by the first cam portion and the second developing coupling by the second cam portion without moving the first drum coupling and the second drum coupling.

15. The image forming apparatus according to claim 14, further comprising a contact-separation mechanism configured to move the second developing roller relative to the second photosensitive drum;

wherein the contact-separation mechanism is configured to permit the second developing roller to be in contact with the second photosensitive drum when the movable member is at the first position, and to permit the second developing roller to be separated from the second photosensitive drum when the movable member is at the second position.

16. The image forming apparatus according to claim 15, wherein the movable member and the contact-separation mechanism are configured such that the movable member is moved to the second position after the contact-separation mechanism separates the second developing roller from the second photosensitive drum.

17. The image forming apparatus according to claim 15, wherein the predetermined direction includes a first direction and a second direction opposite thereto;

wherein the movable member is moved from the first position to the second position when the movable member is moved in the first direction, and wherein the movable member is moved from the second position to the first position when the movable member is moved in the second direction.

18. The image forming apparatus according to claim 17, wherein the movable member has a portion functioning as one of constituents of the contact-separation mechanism such that the movement of the movable member in the predetermined direction causes the second developing roller to move relative to the second photosensitive drum.

19. The image forming apparatus according to claim 15, wherein the contact-separation mechanism is further configured to move the first developing roller relative to the first photosensitive drum such that the first developing roller is in contact with or in separation from the first photosensitive drum; and wherein the contact-separation mechanism causes the first developing roller and the second developing roller to be separated from the first photosensitive drum and the second photosensitive drum respectively when the movable member is at the third position.

20. The image forming apparatus according to claim 19, wherein the movable member and the contact-separation mechanism are configured such that the movable member is moved to the third position after the contact-separation mechanism separates the first developing roller and the second developing roller from the first photosensitive drum and the second photosensitive drum respectively.

21. The image forming apparatus according to claim 14, wherein the first developing coupling has a first pivot portion configured to be pivotally movable relative to the first driving-force inputting section in a direction in which the first developing roller contacts with or separates from the first photosensitive drum; and wherein the second developing coupling has a second pivot portion configured to be pivotally movable relative to the second driving-force inputting section in a direction in which the second developing roller contacts with or separates from the second photosensitive drum.

22. The image forming apparatus according to claim 14, further comprising a drive source configured to apply the first developing-roller driving force and the second developing-roller driving force to the first developing coupling and the second developing coupling, respectively.

23. The image forming apparatus according to claim 22, wherein the drive source is further configured to drive the first photosensitive drum and the second photosensitive drum.

24. The image forming apparatus according to claim 14, wherein the second cam portion protrudes from the movable member outward in the axial direction, and the second cam portion comprises:

a sloped portion sloping relative to the predetermined direction; and a maintaining portion extending in the predetermined direction, wherein the second developing coupling comprises a slide portion configured to slide along the sloped portion and the maintaining portion in accordance with the linear movement of the movable member in the predetermined direction to realize connection and disconnection of the second developing coupling relative to the second driving-force inputting section in the axial direction.

25. The image forming apparatus according to claim 24, wherein the second developing coupling is connected to the second driving-force inputting section while the slide portion is on the sloped portion, and wherein the second developing coupling is disconnected from the second driving-force inputting section while the slide portion is on the maintaining portion.

* * * * *